US005930561A

United States Patent [19]

Hosokawa et al.

[11] Patent Number: 5,930,561

[45] Date of Patent: Jul. 27, 1999

[54] PROCESS CARTRIDGE AND IMAGE-FORMATION DEVICE SUITABLE FOR MINIATURIZATION

[75] Inventors: Hiroshi Hosokawa, Kanagawa; Tetsuo Yamanaka; Masahiro Yonekawa, both of Tokyo; Nahoko Aizawa, Kanagawa, all of Japan

[73] Assignee: Ricoh Company, Ltd., Tokyo, Japan

[21] Appl. No.: 09/048,896

[22] Filed: Mar. 27, 1998

[30] Foreign Application Priority Data

| | | | |
|---|---|---|---|
| Mar. 31, 1997 | [JP] | Japan | 9-080906 |
| Mar. 31, 1997 | [JP] | Japan | 9-080907 |
| Apr. 8, 1997 | [JP] | Japan | 9-089190 |

[51] Int. Cl.[6] ..... G03G 15/00; G03G 21/18

[52] U.S. Cl. ..... 399/111; 399/114

[58] Field of Search ..... 399/111, 110, 399/114, 113, 116, 117; 347/138, 152

[56] References Cited

U.S. PATENT DOCUMENTS

| | | | |
|---|---|---|---|
| 4,598,993 | 7/1986 | Mizutani et al. | 399/111 |
| 5,028,966 | 7/1991 | Kozuka et al. | 399/113 |
| 5,083,158 | 1/1992 | Kashima et al. | 399/114 |
| 5,537,187 | 7/1996 | Sekine | 399/113 |
| 5,581,328 | 12/1996 | Yashiro | 399/111 |
| 5,708,922 | 1/1998 | Azuma et al. | 399/111 |
| 5,749,027 | 5/1998 | Ikemoto et al. | 399/113 |
| 5,752,132 | 5/1998 | Hazama et al. | 399/111 |
| 5,845,176 | 12/1998 | Yoshida et al. | 399/113 |

FOREIGN PATENT DOCUMENTS

| | | |
|---|---|---|
| 6-242642 | 9/1994 | Japan . |
| 7-146634 | 6/1995 | Japan . |

*Primary Examiner*—Arthur T. Grimley
*Assistant Examiner*—Sophia S. Chen
*Attorney, Agent, or Firm*—Oblon, Spivak, McClelland, Maier & Neustadt, P.C.

[57] ABSTRACT

A method of assembling a process cartridge which includes a photosensitive-body case having a photosensitive drum stored therein and a development-body case having a development roller stored therein is proposed. The method includes the steps of positioning a rotation center of the photosensitive drum relative to a rotation center of the development roller by use of a fixture, and fixing relative positions of the photosensitive-body case and the development-body case while the fixture is in place.

31 Claims, 15 Drawing Sheets

PROCESS CARTRIDGE AND IMAGE-FORMATION DEVICE SUITABLE FOR MINIATURIZATION

BACKGROUND OF THE INVENTION

1. Field of the Invention

The present invention generally relates to an image-formation device and a process cartridge used in such a device. The present invention particularly relates to a process cartridge which includes both a photosensitive-body case containing a photosensitive drum and a development-body case containing a development roller, and relates to a method of manufacturing such a process cartridge. Further, the present invention relates to a shutter mechanism of the process cartridge and to a method of opening such a shutter.

2. Description of the Related Art

In related-art image-formation devices such as copier machines or printers, a photosensitive drum and a development roller are contained in a single case, so that the photosensitive drum and the development roller are replaced together by simply replacing the case. Process cartridges based on this configuration are widely available in the market. One requirement for such process cartridges is accurate positioning of the photosensitive drum and the development roller with regard to an interval therebetween. The positioning of these components is generally conducted by providing holding members for securely holding rotation shafts of the photosensitive drum and the development roller and by fixedly mounting the holding members to mounting parts formed on side plates or the like of the case.

The holding members, unfortunately, are bound to have undesirable variations in the size precision thereof, and, also, the mounting parts have variations in positional accuracy when they are formed on the side plates of the case. As different types of such variations are accumulated, the positioning accuracy of the photosensitive drum and the development roller suffers degradation.

Accordingly, there is a need for a process cartridge which can provide accurate positioning of a photosensitive drum and a development roller, and for a method of creating such a process cartridge.

SUMMARY OF THE INVENTION

Accordingly, it is a general object of the present invention to provide a process cartridge and a method of creating the process cartridge which can satisfy the need described above.

It is another and more specific object of the present invention to provide a process cartridge and a method of creating the process cartridge which can provide accurate positioning of a photosensitive drum and a development roller.

In order to achieve the above objects according to the present invention, a method of assembling a process cartridge which includes a photosensitive-body case having a photosensitive drum stored therein and a development-body case having a development roller stored therein includes the steps of positioning a rotation center of the photosensitive drum relative to a rotation center of the development roller by use of a fixture, and fixing relative positions of the photosensitive-body case and the development-body case while the fixture is in place.

In the device described above, the photosensitive-body case and the development-body case are positioned relative to each other by using the fixture to achieve an accurate positioning of the rotation center of the photosensitive drum and the rotation center of the development roller. Since the photosensitive-body case and the development-body case are fixedly connected with each other while the fixture is in place, the process cartridge is obtained with the photosensitive drum and the development roller being accurately positioned.

According to one aspect of the present invention, a recess is provided at each of the rotation center of the photosensitive drum and the rotation center of the development roller, and the fixture is inserted into the recesses to achieve accurate positioning. A simple configuration, therefore, is sufficient for the fixture.

According to another aspect of the present invention, the photosensitive-body case and the development-body case are first connected via a pivot pin, so that they can move about the pivot pin. After this configuration is put in place, the fixture is used for achieving the accurate positioning of the photosensitive drum and the development roller. The positioning process, therefore, can be easily conducted.

According to another aspect of the present invention, a process cartridge assembled as described above is used in an image-formation device.

According to another aspect of the present invention, the photosensitive drum has a cog provided at one end thereof, and, also, the development roller has a cog attached to one end thereof, wherein these two cogs engage each other. Further, the pivot pin which connects the photosensitive-body case with the development-body case is situated such that the photosensitive drum and the development roller are pulled toward each other when they rotate with the two cogs engaging each other. This configuration prevents the photosensitive drum and the development roller from separating from each other during operations of the image-formation device.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

Figure 1:
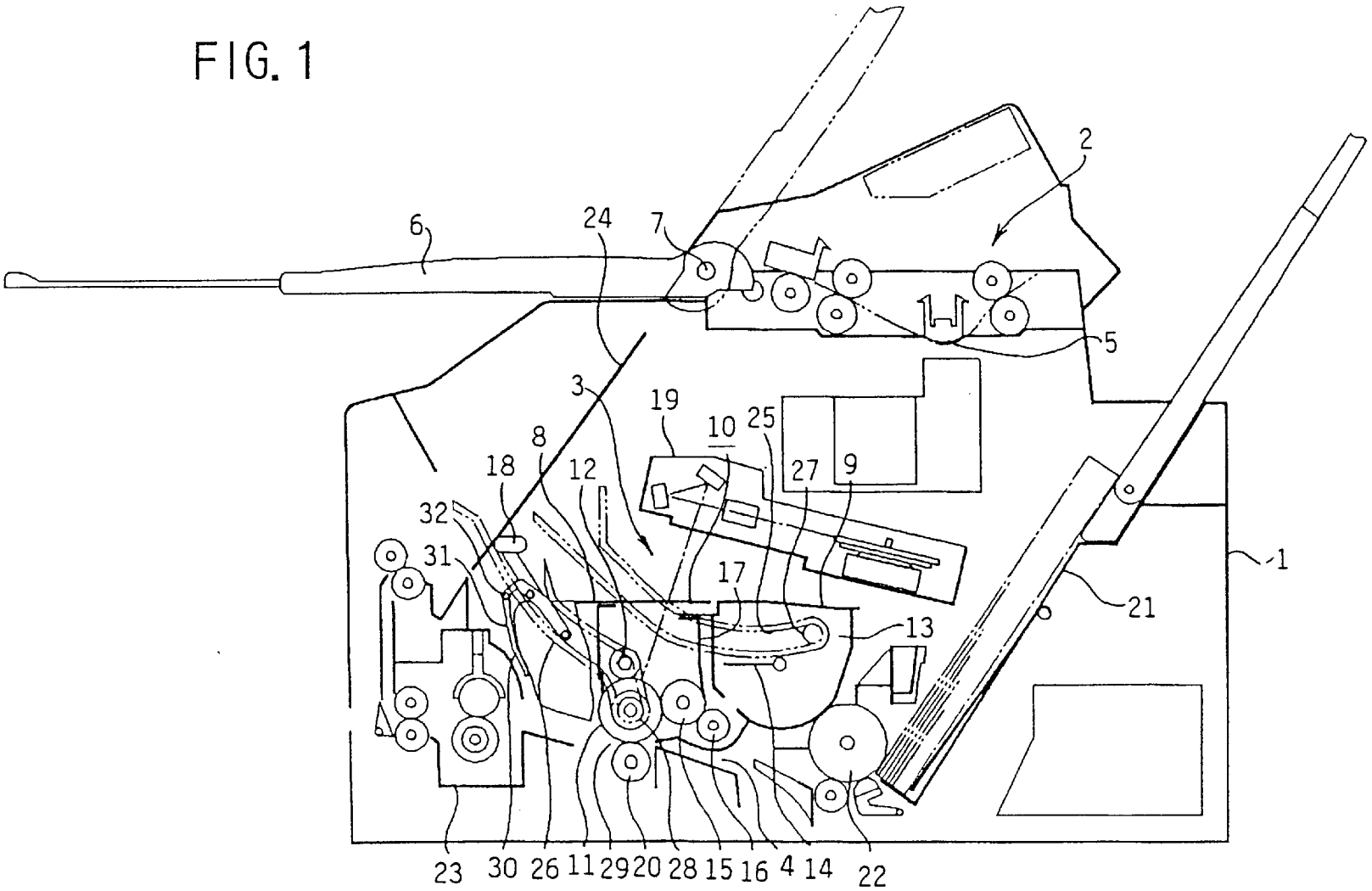
FIG. 1 is an illustrative drawing showing a configuration of an image-formation device which employs a process cartridge of the present invention.

FIG. 1 is an illustrative drawing showing a configuration of an image-formation device which employs a process cartridge of the present invention.

The image-formation device includes a housing case 1 on which an image reading device 2 is mounted for reading document images. A process cartridge 3 is mounted inside the housing case 1 such that the process cartridge 3 can be removed from the housing case 1. Under the process cartridge 3, a paper-sheet path 4 is provided for the purpose of guiding print sheets on which document images are to be printed.

The image reading device 2 includes an image reading unit 5 and a document tray 6 for providing document sheets to the image reading unit 5. The document tray 6 can move around a pivot axis 7 to be placed in a horizontal position shown by solid lines and in a standing position shown in partially dotted lines. A stopper (not shown) is provided to secure the document tray 6 either in the horizontal position or in the standing position.

The process cartridge 3 includes various process components inside a case 10, and a photosensitive-body case 8 and a development-body case 9 are connected together to form the case 10. The photosensitive-body case 8 includes, among other components, a photosensitive drum 11 to be rotated and a charging roller 12 for uniformly applying electrical charge to a round surface of the photosensitive drum 11. The development-body case 9 includes a development-agent container 13 for storing development agent. Here, the development-agent container 13 is integrally formed with the development-body case 9. The development-body case 9 further includes an agitating unit 14 for stirring the development agent inside the development-agent container 13, a development roller 15 urged against the round surface of the photosensitive drum 11, a supply roller 16 for supplying the development agent from the development-agent container 13 to the development roller 15, and a development blade 17 placed in contact with the round surface of the development roller 15. An upper surface of the development-body case 9 is provided with a handle 18, which is used when removing or inserting the process cartridge 3 from or into the housing case 1 by hand.

Around the process cartridge 3 inside the housing case 1 are provided a laser printing unit 19, a transfer roller 20, a paper-supply tray 21, a paper-supply roller 22, a fixation unit 23, and a paper-holding plate 24. The laser printing unit 19 generates a static latency image on the round surface of the photosensitive drum 11. The transfer roller 20 transfers a toner image from the photosensitive drum 11 to a print sheet after the toner image is created by supplying the development agent from the development roller 15 to the photosensitive drum 11. The paper-supply tray 21 is kept in such a position so as to hold a stack of print sheets on a slanted surface. The paper-supply roller 22 supplies the print sheets. The fixation unit 23 fixes the toner image after it is transferred onto a supplied printed sheet. The paper-holding plate 24 keeps the printed sheets in place after they are supplied from the fixation unit 23.

Each of the side plates of the housing case 1 is provided with two guides 25 and 26 formed thereon. The guides 25 and 26 guide the process cartridge 3 when the process cartridge 3 is removed from or inserted into the housing case 1. Each of the side surfaces of the case 10 has two guide pins 27 and 28 formed thereon, and the guide pins 27 and 28 fit in the guides 25 and 26, respectively. Removal or insertion of the process cartridge 3 is carried out from a side of the housing case 1 where the paper-holding plate 24 is located. When the removal or the insertion is to be attempted, the paper-holding plate 24 is rotated to provide space for the process cartridge 3.

The case 10 is provided with an opening 29, through which the photosensitive drum 11 comes in contact with the transfer roller 20. A shutter member 30 is attached to the process cartridge 3, and covers the opening 29 when it should be protected. The shutter member 30 is supported by an arm member 31, which is attached to the side surfaces of the case 10 to move about a pivot point. Before the process cartridge 3 is inserted into the housing case 1, the shutter member 30 is positioned to close the opening 29 with help of an urging force by a spring (not shown), which is attached to the shutter member 30 and the arm member 31. When the process cartridge 3 is mounted inside the housing case 1, a pin 32 formed on the arm member 31 slides in the guide 26 to receive an urging force from the guides 25 and 26, so that the arm member 31 moves about the pivot point to position the shutter member 30 clear from the opening 29.

In the following, a configuration of the process cartridge 3 and a method of assembling the process cartridge 3 will be described.

Figure 2:
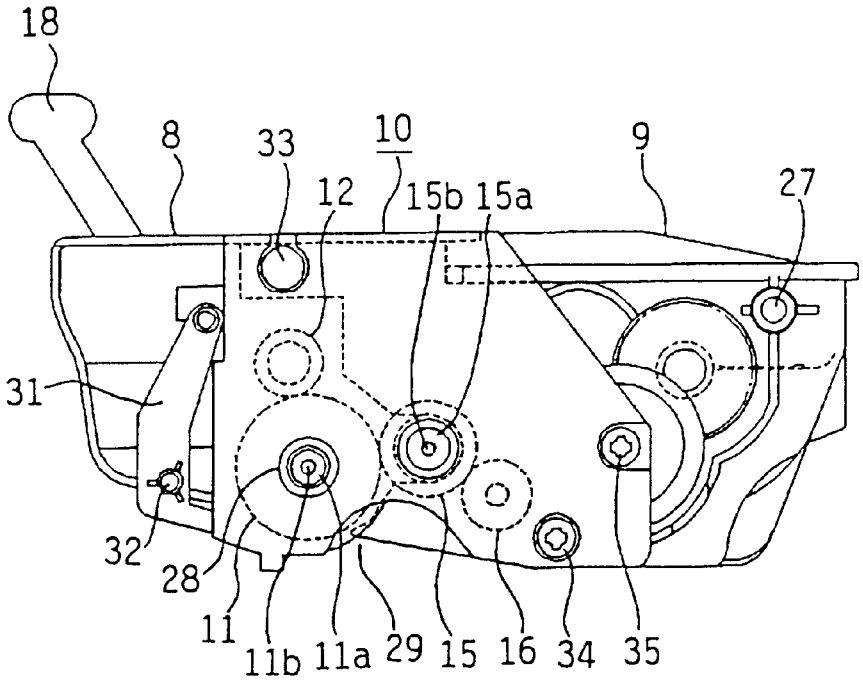
FIG. 2 is an illustrative drawing showing a detailed configuration of the process cartridge.

FIG. 2 is an illustrative drawing showing a detailed configuration of the process cartridge 3.

As previously described, the process cartridge 3 is comprised of the photosensitive-body case 8 and the development-body case 9 connected together to form the case 10, in which various process components are provided. The photosensitive-body case 8 and the development-body case 9 are connected together by a pivot pin 33, which is provided near the top of the case 10, so that the photosensitive-body case 8 and the development-body case 9 can move about the pivot pin 33. The photosensitive-body case 8 and the development-body case 9 are fixed relative to each other by screws 34 and 35, which are located near the bottom of the case 10. The pivot pin 33 is parallel to the rotation axes of the photosensitive-body case 8 and the development-body case 9. A rotation-center rod 11*a* of the photosensitive drum 11 has a recess 11*b* at either end thereof such that the recess 11*b* is positioned at an exact center of the rotation-center rod 11*a*. By the same token, a rotation-center rod 15*a* of the development roller 15 has a recess 15*b* at either end thereof such that the recess 15*b* is positioned at an exact center of the rotation-center rod 15*a*. The recess 11*b* and the recess 15*b* are used when connecting the photosensitive-body case 8 with the development-body case 9, such that a fixture (not shown) is inserted into the recess 11*b* and the recess 15*b* to effect accurate positioning.

When the photosensitive-body case 8 and the development-body case 9 are to be fixedly connected together, the photosensitive-body case 8 and the development-body case 9 are first connected via the pivot pin 33 so as to move about the pivot pin 33. Then, the fixture is inserted into the recess 11*b* of the rotation-center rod 11*a* and into the recess 15*b* of the rotation-center rod 15*a* so as to effect accurate positioning of the rotation axes of the photosensitive drum 11 and the development roller 15. While the accurate position is kept in place, the screws 34 and 35 are fastened to fixedly connect the photosensitive-body case 8 and the development-body case 9 together.

Figure 3A:
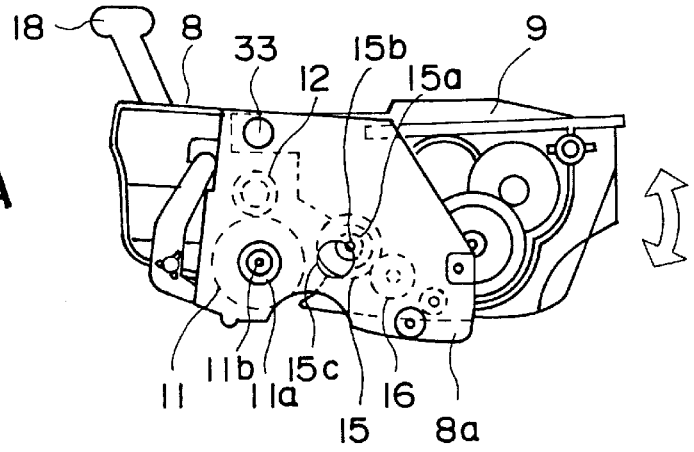
FIGS. 3A through 3C are illustrative drawings for explaining how a photosensitive-body case and a development-body case are fixedly connected together.
Figure 3B:
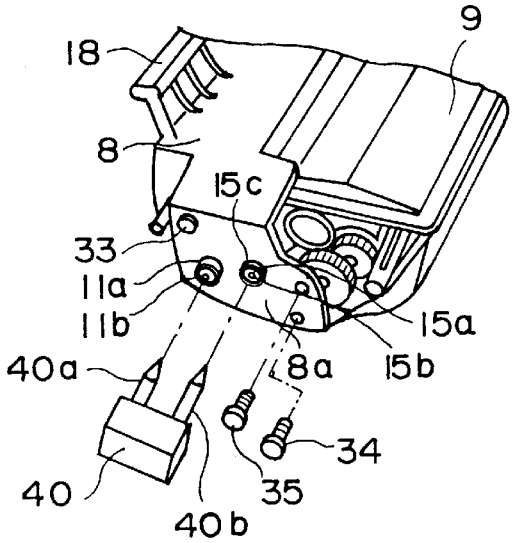
Figure 3C:
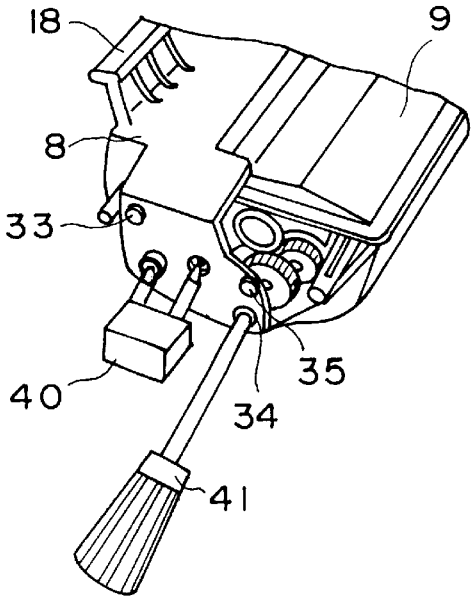

FIGS. 3A through 3C are illustrative drawings for explaining how the photosensitive-body case 8 and the development-body case 9 are fixedly connected together.

As shown in FIG. 3A, when the photosensitive-body case 8 and the development-body case 9 are connected only by the pivot pin 33, the photosensitive-body case 8 and the development-body case 9 can move about the pivot pin 33 relative to each other.

As shown in FIG. 3B, the photosensitive-body case 8 and the development-body case 9 are adjusted with regard to relative positions thereof, so that the recess 15*b* of the rotation-center rod 15*a* can be seen through an opening 15*c* formed through a side plate 8*a* of the photosensitive-body case 8. As shown in the figure, a fixture 40 is provided with pins 40*a* and 40*b* which have a pointing end. The pointing end of the pin 40*a* and the pointing end of the pin 40*b* are formed such that the recess 11*b* of the rotation-center rod 11*a* and the recess 15*b* of the rotation-center rod 15*a* are fixed in a desired position when these pointing ends are inserted into the corresponding recesses.

As shown in FIG. 3C, the screws 34 and 35 are fastened by using a screw driver 41 while the fixture 40 is in place to secure the positions of the photosensitive-body case 8 and the development-body case 9. In this manner, the photosensitive-body case 8 and the development-body case 9 are fixedly connected to each other to complete the case 10.

In what follows, positional relations between the photosensitive drum 11, the development roller 15, and the pivot pin 33 will be described.

Figure 4:
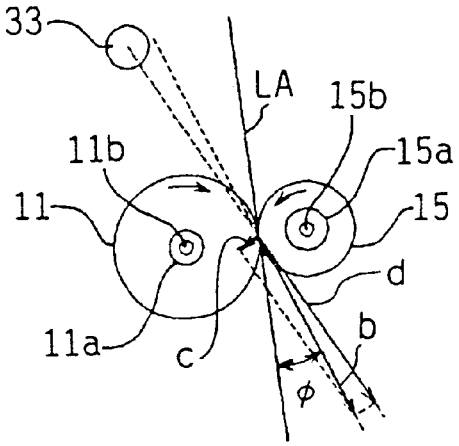
FIG. 4 is an illustrative drawing showing relations between a photosensitive drum, a development roller, and a pivot pin.

FIG. 4 is an illustrative drawing showing the relations between the photosensitive drum 11, the development roller 15, and the pivot pin 33.

As shown in FIG. 4, when the photosensitive-body case 8 and the development-body case 9 are fixedly connected, the photosensitive drum 11 and the development roller 15 are urged against each other with a surface dent of a predetermined depth (0.1±0.08 mm) being introduced by urging pressure between the two surfaces. A cog (not shown) attached to one end of the photosensitive drum 11 engages a cog (not shown) attached to one end of the development roller 15. A reference pitch line LA shown in FIG. 4 is perpendicular to a line connecting between the rotation axis of the photosensitive drum 11 and the rotation axis of the development roller 15. In the figure, an arrow b at an angle $\phi$ relative to the reference pitch line LA shows a direction in which a pressure from one cog is applied to the other cog. In the configuration of the present invention, the pivot pin 33 is positioned on a line which is at an angle larger than the angle $\phi$.

Since the photosensitive drum 11, the development roller 15, and the pivot pin 33 are positioned relative to each other as shown in FIG. 4, there is a force, as indicated by an arrow c, which pulls the photosensitive drum 11 and the development roller 15 closer to each other when the photosensitive drum 11 and the development roller 15 are rotated. This force is part of the force which is applied from one cog to the other cog in a direction indicated by the arrow b at a location where teeth of these cogs come in contact. As shown in FIG. 4, the force indicated by the arrow b is a composite of the partial force indicated by the arrow c and another partial force indicated by an arrow d because of this particular spatial arrangement of the pivot pin 33. In this configuration, therefore, no force is present to push the development roller 15 apart from the photosensitive drum 11, thereby preventing a development process from suffering degradation caused by separation of the photosensitive drum 11 from the development roller 15.

In the following, another problem of an image-formation device having a process cartridge therein will be described.

In recent years, image-formation devices are normally structured such that not only a toner cartridge but also photosensitive parts are subject to replacement as consumed goods. Such a configuration is encouraged by a decrease in the price of the photosensitive parts. For the purpose of easy replacement of a toner cartridge and photosensitive parts, a process cartridge contains a toner cartridge, an image-process unit including such as electric charge components and photosensitive parts together.

Users who have no choice but to install an image-formation device in a small space wish to have as small an image-processing device as possible. To meet this demand and to target this market segment, some image-formation devices have various device components tightly packed therein. Because of this, a process cartridge needs to be stored in a small space inside the image-formation device.

When a process cartridge is inserted into the device, the process cartridge engages the interior of the device to securely fit in an appropriate space, thereby preventing the process cartridge from being displaced during operations of the image-formation device. When a user inserts the process cartridge, the user can check if the process cartridge is securely put in place by detecting a sound, which is made when the process cartridge engages the interior of the device.

Image-formation devices designed to target the above-mentioned market segment need to have interior components thereof densely arranged in order to make a size of the whole device as small as possible. In such image-formation devices, a sufficient design consideration is not usually given to a handle of the process cartridge because of a seemingly insignificant nature of such a handle with regard to whether the handle is easy to hold or not, for example. Because of this, most process cartridges do not have a sufficiently large handle, and, in some cases, it is even difficult to tell which part is supposed to be a handle. In these cases, users who are not familiar with a task may find difficulties in replacing a process cartridge.

Even when a process cartridge is supposed to make a sound upon secure installment into a device, a user may think he/she has completed the task while leaving the process cartridge in an insecure position if the user does not know that the process cartridge makes a sound when securely placed. In this case, the image-formation device starts operations while the process cartridge is not securely installed.

Accordingly, there is a need for a process cartridge and an image-formation device wherein the process cartridge has a handle which is easy to find, and allows an easy check to be made as to if the process cartridge is securely put in place.

Figure 5:
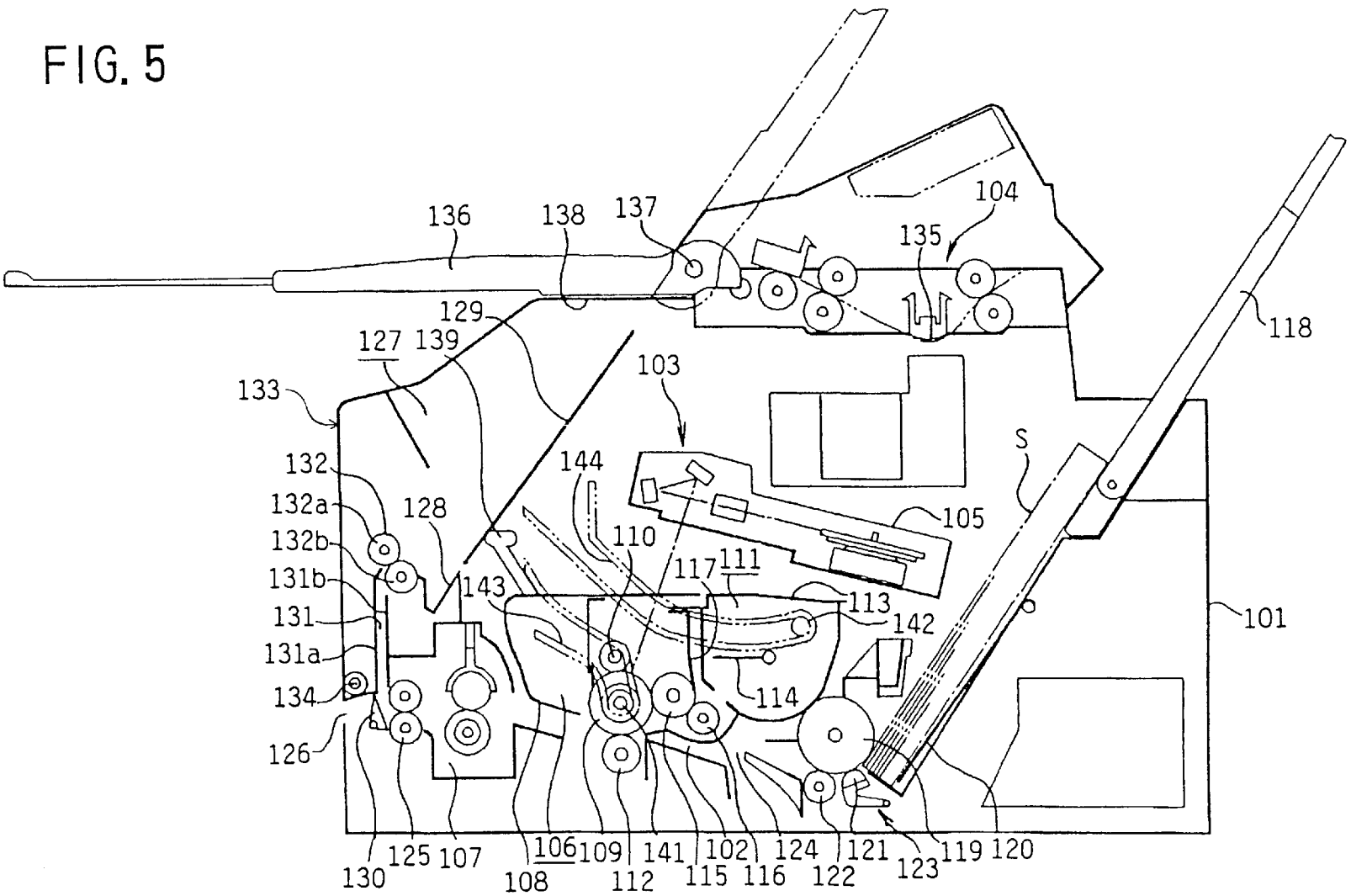
FIG. 5 is an illustrative drawing showing a configuration of an image-formation device according to the present invention.

FIG. 5 is an illustrative drawing showing a configuration of an image-formation device according to the present invention. FIG. 5 shows a substantially identical configuration in comparison with FIG. 1, but is tailored to the purpose of delineating features of the present invention with regard to a handle and a secure installment of a process cartridge.

In FIG. 5, the left-hand side of the figure coincides with a front side of the image-formation device. The image-formation device includes a housing case 101, a paper-sheet path 102 provided near to the bottom of the housing case 101, a printing unit 103 provided above the paper-sheet path 102 for the purpose of printing a sheet supplied through the paper-sheet path 102, and a scanner unit 104 provided above the printing unit 103 for the purpose of reading document images.

The printing unit 103 includes a latency-image-formation unit 105, a process cartridge 106, and a fixation unit 107. The process cartridge 106 is structured such that a unit case 108 has a photosensitive drum 109 attached thereto in a rotatable manner, and includes a charging roller 110 and a development unit 111 arranged around the photosensitive drum 109. The photosensitive drum 109 is in contact with a transfer roller 112 provided inside the housing case 101. The development unit 111 includes a development-agent container 113 integrally formed with the unit case 108, an agitating unit 114 for stirring the development agent inside the development-agent container 113, a development roller 115 urged against the photosensitive drum 109, a supply roller 116 for supplying the development agent to the development roller 115, and a development blade 117 placed in contact with the development roller 15.

The latency-image-formation unit 105 is provided above the process cartridge 106, and scans a laser beam on an electrically charged surface of the photosensitive drum 109 while the laser beam is modulated by image signals. These scans create a latency image on the photosensitive drum 109.

Near the back side of the housing case 101, a paper-supply tray 118 is provided to support document sheets supplied from the scanner unit 104 after the document sheets are read. The paper-supply tray 118 also keeps a stack of sheets S on a slanted plate. Around the bottom of the paper-supply tray 118 are provided a paper-supply roller 119, a pressure plate 120, a separation pad 121, and a pinch roller 122. The paper-supply roller 119 is rotated while the pressure plate 120 presses a stack of sheets S against the paper-supply roller 119. The separation pad 121 and the pinch roller 122 are elastically pressed against the paper-supply roller 119 so as to prevent more than one sheet at a time from being supplied. The paper-supply tray 118, the paper-supply roller 119, the pressure plate 120, the separation pad 121, and the pinch roller 122 together constitute a paper-supply unit 123.

The paper-supply roller 119, the separation pad 121, and the pinch roller 122 are situated near to an entry point to the paper-sheet path 102. The paper-sheet path 102 is connected to a bottom path 124, which is located downstream in comparison to the paper-supply roller 119. The image-formation device shown in FIG. 5 may be used with a separate paper-supply device (not shown) such that the housing case 101 is placed on the paper-supply device. In this configuration, sheets of paper are supplied from the separate paper-supply device to the image-formation device via the bottom path 124.

The fixation unit 107 is situated downstream from the paper-sheet path 102, and fixes an image on a paper sheet after the image is transferred onto the sheet. A first paper ejecting roller 125 resides further down the stream than the fixation unit 107. Also, a paper ejecting slot 126 is provided on the front side of the housing case 101 to eject printed sheets in a horizontal direction.

Further, a paper-sheet stacker 127 is provided above the fixation unit 107, and is exposed upward through an opening of the housing case 101. The paper-sheet stacker 127 includes a bottom part 128 and a paper receiving plate 129 which holds sheets of paper thereon and serves as a wall to separate the paper-sheet stacker 127 from the printing unit 103.

Near to the paper ejecting slot 126, a switch hook 130 which can move about a pivot center is provided. The switch hook 130 is situated between the first paper ejecting roller 125 and the paper ejecting slot 126, and guides a sheet supplied from the first paper ejecting roller 125 toward an upward direction away from the paper ejecting slot 126 when the switch hook 130 is set in a standing position.

A turned-paper ejecting path 131 is provided between the switch hook 130 and the paper-sheet stacker 127 for the purpose of guiding sheets of paper. The turned-paper ejecting path 131 is made from a pair of turned-paper ejecting guides 131*a* and 131*b*. At the top of the turned-paper ejecting path 131, sheets of paper are supplied to the paper-sheet stacker 127 by a second paper ejecting roller 132. The second paper ejecting roller 132 includes a pair of rollers 132*a* and 132*b*.

A cover 133 forms a front side of the housing case 101, and can be opened. The cover 133 is supported by and moves about a pivot pin 134. The bottom part 128 and the paper receiving plate 129 of the paper-sheet stacker 127 as well as the turned-paper ejecting guide 131*a* and the roller 132*a* are attached to and move together with the cover 133.

The scanner unit 104 provided on the housing case 101 includes an image-reading unit 135 for reading document images and a document table 136 for keeping a stack of document sheets which is fed to the image-reading unit 135. The document table 136 is supported by and can move about a pivot pin 137.

The document table 136 can move between a document guiding position for guiding document sheets and a sheet receiving position for receiving ejected and printed sheets. The document table 136 in the document guiding position is shown by solid lines in FIG. 5, and extends in a direction in which document sheets are supplied to the scanner unit 104. In the document guiding position, the document table 136 is securely supported by the table support 138, which is formed as part of the cover 133.

The document table 136 in the sheet receiving position is shown by partially dotted lines in FIG. 5. The housing case 101 is provided with a stopper (not shown) to securely hold the document table 136 at the sheet receiving position. In the sheet receiving position, a back side of the document table 136 extends along an imaginary extension of the paper receiving plate 129, and, thus, resides in a direction in which printed sheets are ejected. In this manner, the document table 136 in the sheet receiving position serves as an auxiliary means to receive ejected documents.

On an upper surface of the scanner unit 104 is provided an operation unit (not shown) in the form of a panel. When a copy mode is selected, the operation unit is used for making settings of the number of copies, a document size, a proportion of copy-size conversion, etc. When a facsimile mode is selected, a user is prompted to enter a telephone number to which a document is to be faxed, for example. The operation unit has a display unit (not shown) on one side thereof, for example, so that the display unit can display operation conditions of the printing unit 103 regarding a power-on/off state, an error state, an occurrence of jamming, a communication state as to whether the printing unit 103 is in the process of communicating with a personal computer, etc.

Figure 6:
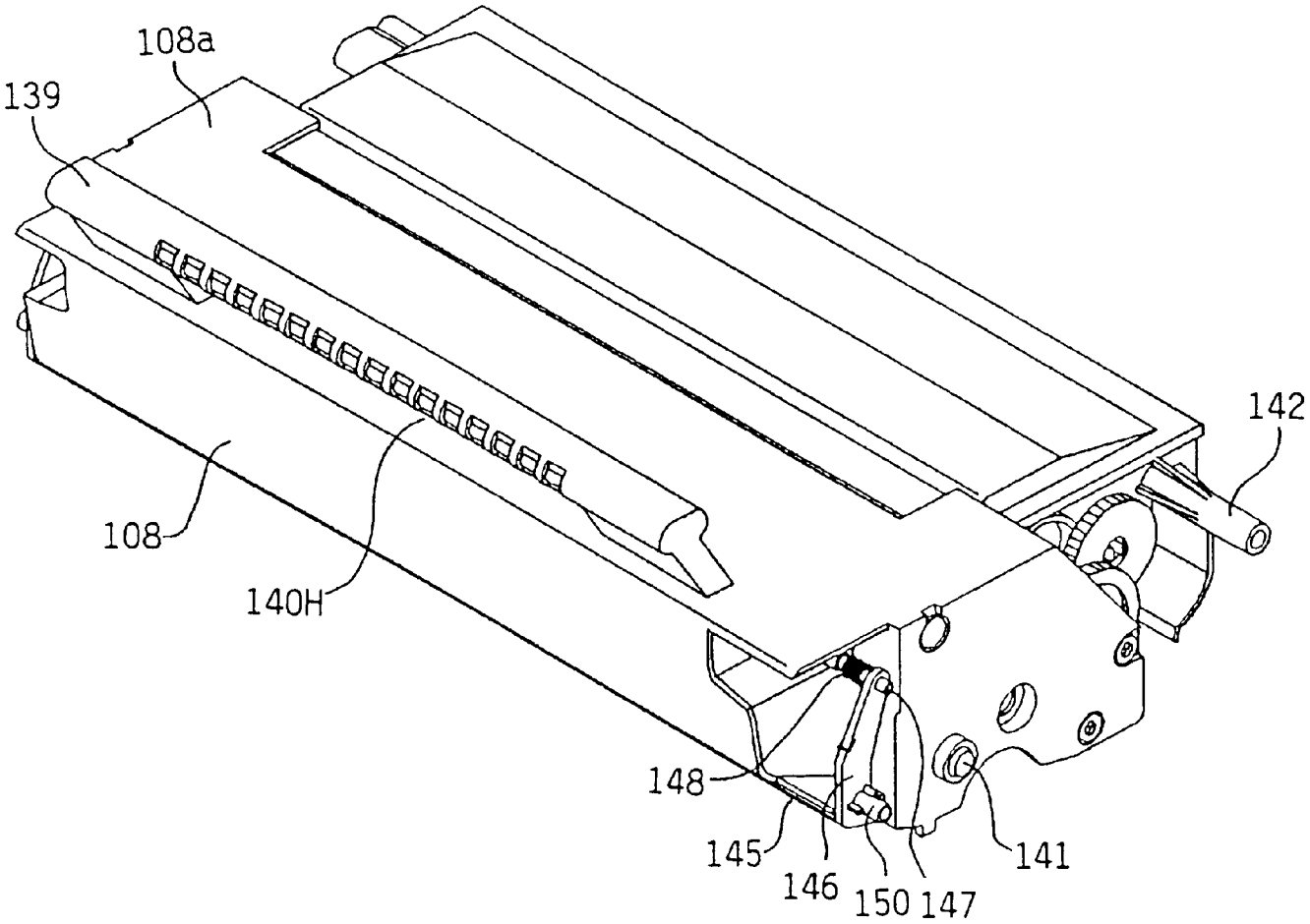
FIG. 6 is a perspective view of a process cartridge of FIG. 5.
Figure 7:
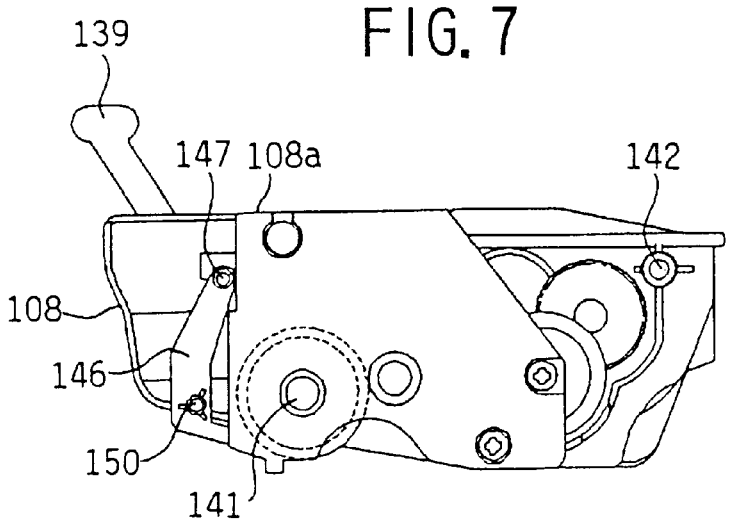
FIG. 7 is a side view of the process cartridge.
Figure 8:
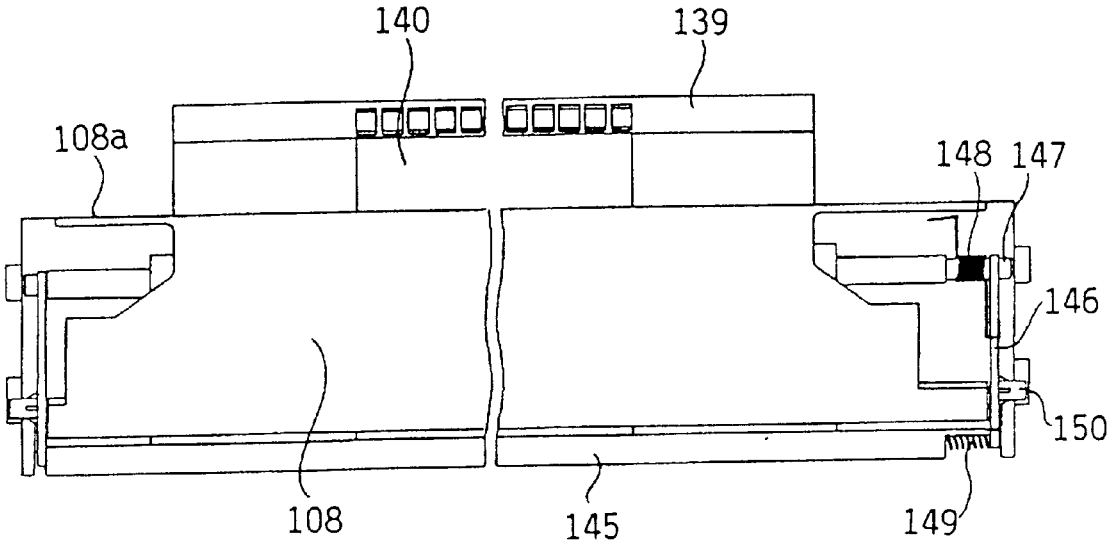
FIG. 8 is a front view of the process cartridge.

FIG. 6 is a perspective view of the process cartridge 106. FIG. 7 is a side view of the process cartridge 106. FIG. 8 is a front view of the process cartridge 106. With reference to FIGS. 6 through 8, a detailed description will be provided with regard to the process cartridge 106.

The unit case 108 of the process cartridge 106 has a handle 139 attached to an upper surface 108*a* thereof. The upper surface 108*a* is substantially a flat surface. The handle 139 is grabbed by hand when removing the process cartridge 106 from the housing case 101 or inserting the process cartridge 106 into the housing case 101. The handle 139 extends in a longitudinal direction of the unit case 108, and has holes 140H. The handle 139 has such a height that the very top of the handle 139 just touches a back side of the paper receiving plate 129, which is an innermost part of the cover 133, when the process cartridge 106 is correctly placed in the housing case 101.

Each side of the unit case 108 is provided with a first protrusion 141 and a second protrusion 142. The first protrusion 141 is positioned in a proximity of the rotation axis of the photosensitive drum 109, and the second protrusion 142 is attached to the development-agent container 113. The first protrusion 141 fits into a first guiding groove 143 provided inside the housing case 101. Also, the second protrusion 142 fits into a second guiding groove 144 formed inside the housing case 101.

The first guiding groove 143 and the second guiding groove 144 form a path along which the process cartridge 106 is taken out or inserted, and serve to guide the first protrusion 141 and the second protrusion 142, respectively. The handle 139 is provided on the upper surface 108*a* of the unit case 108 at an angle which corresponds to a direction of the path formed by the first guiding groove 143 and the second guiding groove 144.

The unit case 108 has a shutter 145 which covers the photosensitive drum 109 when the process cartridge 106 is not placed inside the housing case 101. The shutter 145 has an arm 146 on either side thereof, and the arms 146 extend in a direction perpendicular to the longitudinal direction. Each of the arms 146 has one end thereof attached to the shutter 145 so as to be able to rotate around the attached point, and has the other end thereof attached to a side surface of the unit case 108 via a pivot pin 147 so as to be able to move about the pivot pin 147. The arms 146 are urged in one direction such that a force is applied to the shutter 145 to close the same. This urging force is provided by a spring 148 coiled around the pivot pin 147.

A spring 149 is provided at a connection point between the arm 146 and the shutter 145 such that the spring 149 urges the shutter 145 against the unit case 108. Further, an engaging part 150 having a shape like a protrusion is provided in a proximity of the connection point between the arm 146 and the shutter 145.

With reference to FIG. 5 again, when a document image is to be scanned, a document sheet is fed into the image-reading unit 135 while keeping the document table 136 in the horizontal document guiding position. The image-reading unit 135 scans the document image on the document sheet, and ejects the document sheet, which is then supported by a slanting surface of the paper-supply tray 118. The scanned image is transmitted to a remote site when the operation mode is a facsimile-transmission mode. Alternately, the scanned image is printed on a sheet S supplied from the paper-supply tray 118 when the operation mode is a copy mode. There is also a facsimile receiving mode, in which an image transmitted from a remote site may be printed on the sheet S.

When printing an image on a sheet S, the photosensitive drum 109 rotates in a clockwise direction in FIG. 5 while the surface thereof is electrically charged by the charging roller 110. Further, the latency-image-formation unit 105 forms an electro-static latency image on the charged surface of the photosensitive drum 109 when the image is scanned or sent from a remote site. The latency image is developed by the development unit 111. The developed image is then transferred onto the sheet S, which is supplied from the paper-supply tray 118 by the paper-supply roller 119. The image transferred onto the sheet S is fixed when the sheet S passes through the fixation unit 107. Finally, the sheet having a printed image thereon is ejected from the device.

When the document table 136 is placed in the sheet receiving position during the print process, an operator can select a direction in which the sheet S is ejected. Since the housing case 101 is designed to have a relatively short height because of a demand for a compact size, the paper-sheet stacker 127 may not have a sufficient depth to support the sheet S securely. Even in this case, however, the document table 136 along with the paper receiving plate 129 can support the ejected sheet S securely since the document table 136 is positioned to extend along an imaginary extension of the paper receiving plate 129.

When the document table 136 is moved over to the document guiding position, a sensor (not shown) detects this position of the document table 136 to drive a solenoid (not shown) attached to the switch hook 130, so that the switch hook 130 is automatically placed in a position to eject sheets through the paper ejecting slot 126. In this manner, the operator has no choice as to where to eject the sheets when the document table 136 is placed in the document guiding position and covers the paper-sheet stacker 127. All the sheets S in this case are ejected through the paper ejecting slot 126.

The document table 136 may be connected to the switch hook 130 via a connection lever, so that a positional change of the document table 136 results in a positional change of the switch hook 130. In this configuration, changing a position of the document table 136 to the document guiding position moves the switch hook 130 such that the position of ejecting the sheets S is automatically switched to the paper ejecting slot 126.

In the image-formation device according to the present invention, the operator first opens the cover 133 when there is a need to replace the process cartridge 106. The operator then removes the process cartridge 106 by holding the handle 139. It is fair to assume that the operator intuitively attempts to pull the handle 139 in a direction in which the handle 139 extends from the process cartridge 106. Based on this assumption, the handle 139 of the present invention is designed to extend along a direction which matches a general direction of the first guiding groove 143 and the second guiding groove 144. Because of this, the operator can take out the process cartridge 106 smoothly without failing to find a correct direction to pull the process cartridge 106.

The process cartridge 106 removed from the housing case 101 has the photosensitive drum 109 covered by the shutter 145 since the shutter 145 is urged by the spring 148.

Then, the operator inserts a new process cartridge 106. When the new process cartridge 106 is placed in an appropriate position, the engaging part 150 engages a counterpart (not shown) provided in the housing case 101. In this position, the shutter 145 is opened so that the photosensitive drum 109 is exposed inside the housing case 101. After the placement of the process cartridge 106, the cover 133 is shut.

Figure 9A:
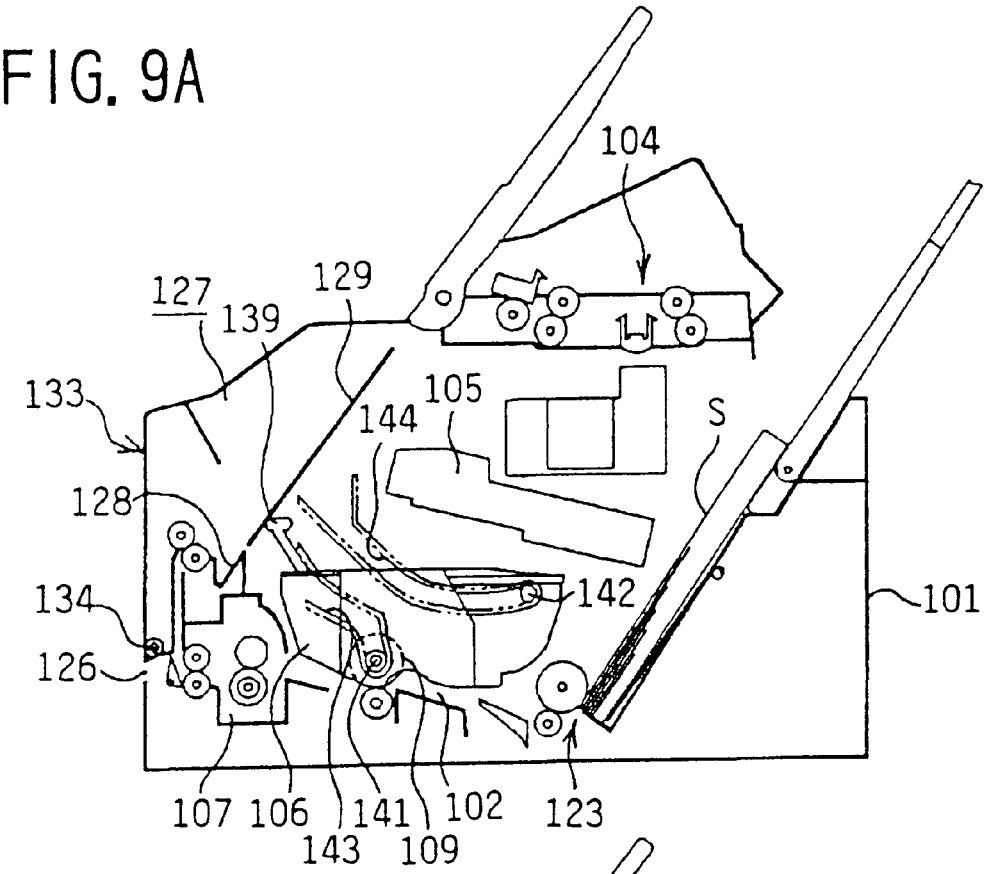
FIG. 9A is an illustrative drawing showing an appropriate position of the process cartridge when a cover is shut.
Figure 9B:
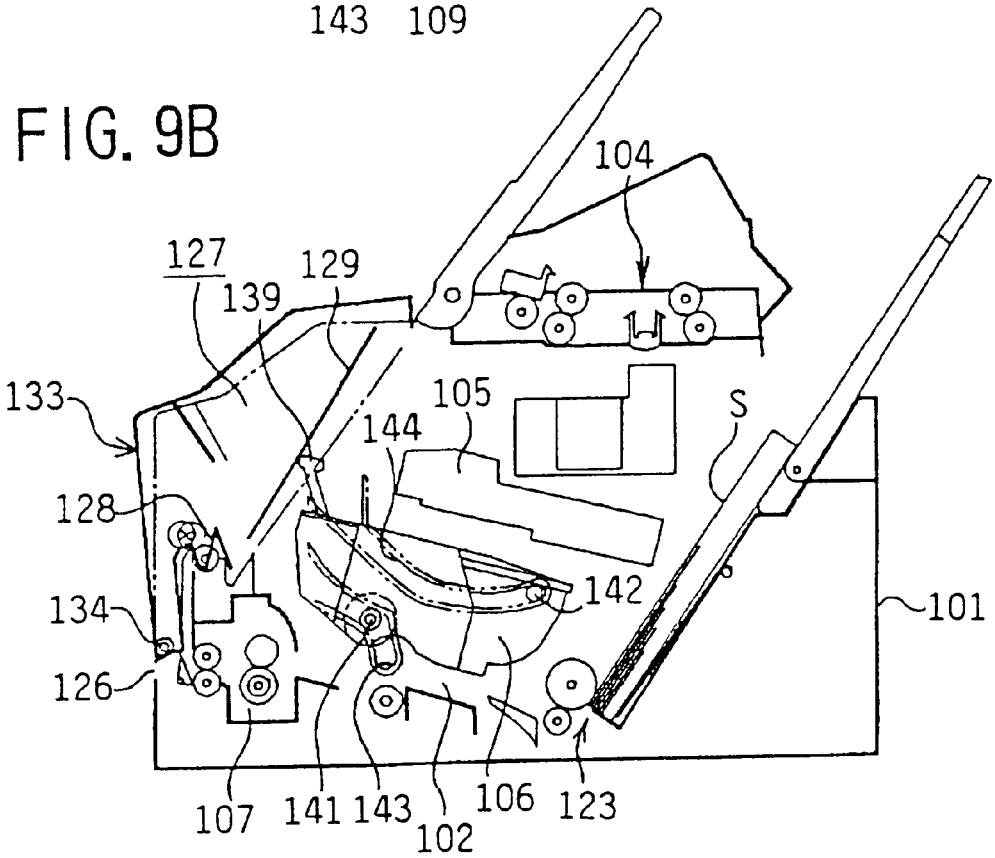
FIG. 9B is an illustrative drawing showing a case in which the process cartridge is not placed in the appropriate position.

FIG. 9A is an illustrative drawing showing the appropriate position of the process cartridge 106 when the cover 133 is shut. FIG. 9B is an illustrative drawing showing a case in which the process cartridge 106 is not placed in an appropriate position.

As shown in FIG. 9B, when the process cartridge 106 is not inserted until it hits an end of the first guiding groove 143 and the second guiding groove 144, the interior of the cover 133 (i.e., the back side of the paper receiving plate 129) collides with the tip of the handle 139. By this fact, the operator can know that the process cartridge 106 is not placed in an appropriate position. This alarming mechanism can be implemented by a simple mechanical configuration rather than using a sensor for checking a position of the process cartridge 106 and providing a display to inform the operator of an inappropriate positioning of the process cartridge 106. When the process cartridge 106 is not placed in an appropriate position, the operator may shut the cover 133 with a little bit of an extensive force so that the paper receiving plate 129 pushes the handle 139, thereby placing the process cartridge 106 in the appropriate position.

Since the handle 139 is large, the operator can easily grab the handle 139 even if the operator is not standing in front of the device. Further, the holes 140 are formed through the handle 139, so that heat generated by the fixation unit 107, which is positioned close to the process cartridge 106, can escape rather than being trapped under the handle 139. Heat easily escapes in this manner despite the large size of the handle 139. Further, the holes 140 serve as a means for allowing the operator to have an easy and secure grip of the handle 139.

As described above, the present invention provides the process cartridge having the handle projecting from the upper surface of the cartridge case, so that it is easy to spot the handle by taking only a glimpse of the process cartridge. Since the handle is designed such that the top of the handle barely touches the interior surface of the cover when the cover is shut, the cover cannot be completely shut when the process cartridge is not placed in an appropriate position. This configuration allows an easy detection to be made with regard to inappropriate placement of the process cartridge.

According to another aspect of the present invention, the handle extends to a length in the longitudinal direction of the process cartridge, so that the handle is easily spotted and recognized as a handle. Since the handle has a substantially long extension, it is easy to grasp regardless of the position of an operator with respect to the device, and either one hand or both hands can be used for gripping the handle.

According to another aspect of the present invention, the handle projects in a direction along which the process cartridge is removed from the device, so that pulling of the handle toward the direction of the handle projection gives a smooth removal of the process cartridge.

According to another aspect of the present invention, the fixation unit of the image-formation device is situated generally under the handle when the process cartridge is placed in an appropriate position inside the image-formation device. Since the handle is provided with holes, heat generated by the fixation unit is not trapped under the handle but can escape despite a relatively large size of the handle.

According to another aspect of the present invention, since the handle is designed such that the top of the handle barely touches the interior surface of the cover when the cover is shut, a little bit of excess force to shut the cover can place the process cartridge in an appropriate position even when the process cartridge is initially placed out of the appropriate position.

In the following, yet another problem of an image-formation device having a process cartridge therein will be described.

In related-art image-formation devices such as copier machines or printers, a photosensitive drum and a development roller are contained in a single case, so that the photosensitive drum and the development roller are replaced together by simply replacing the case. A process cartridge based on such a configuration has an opening in the case, and the photosensitive drum comes in contact with a transfer member inside an image-formation device through this opening when the process cartridge is placed in the image-formation device.

If the photosensitive drum is touched by a hand or unexpectedly comes in contact with other material, a touched/contacted portion on the photosensitive drum may impair an image formed thereon. As a result, an image transferred to a sheet of paper may sustain an undesirable artifact. To counter this problem, a shutter is usually provided for the process cartridge with an aim of covering the opening of the case. This shutter covers the opening when the process cartridge is not placed inside the image-formation device, and opens to expose the photosensitive drum when the process cartridge is put in place inside the image-formation device.

A conventional shutter used in the related art swings to trace an arc-like path with an end edge thereof when the shutter is opened. In other words, the cover is at least partially released from the case as it opens, so that the end edge of the cover hangs in the air when the shutter is in an open position.

In recent years, an effort has been directed to miniaturization of an image-formation device. As a progress is made toward this end, various components tend to be tightly packed inside the image-formation device, leaving little space around the process cartridge.

Because of this, process cartridges designed to be of a small size encounter difficulties in providing a shutter for the purpose of covering the opening since there is little space for the shutter to open inside an image-formation device.

Accordingly, there is a need for a shutter mechanism which can be used for a process cartridge of an image-formation device of a small size.

Figure 10:
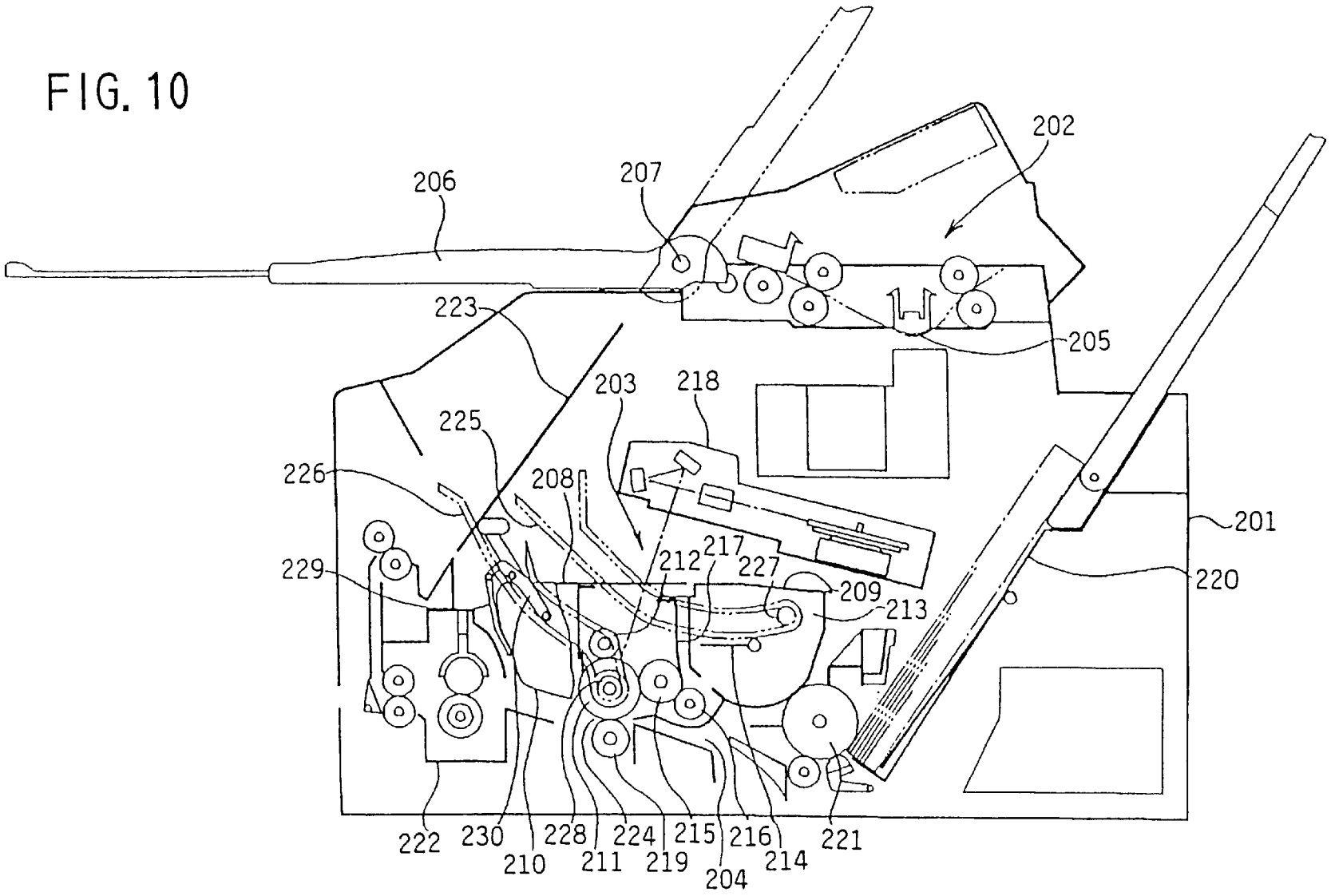
FIG. 10 is an illustrative drawing showing a configuration of an image-formation device according to the present invention.

FIG. 10 is an illustrative drawing showing a configuration of an image-formation device according to the present invention. FIG. 10 shows a substantially identical configuration in comparison with FIG. 1 or FIG. 5, but is tailored to the purpose of delineating features of the present invention with regard to a shutter mechanism.

The image-formation device includes a housing case 201 on which an image reading device 202 is mounted for reading document images. A process cartridge 203 is mounted inside the housing case 201 such that the process cartridge 203 can be removed from the housing case 201.

Under the process cartridge 203, a paper-sheet path 204 is provided for the purpose of guiding print sheets on which document images are to be printed.

The image reading device 202 includes an image reading unit 205 and a document tray 206 for providing document sheets to the image reading unit 205. The document tray 206 can move around a pivot axis 207 to be placed in a horizontal position shown by solid lines and in a standing position shown by partially dotted lines. A stopper (not shown) is provided to secure the document tray 206 either in the horizontal position or in the standing position.

The process cartridge 203 includes various process components inside a case 210, and a photosensitive-body case 208 and a development-body case 209 are connected together to form the case 210. The photosensitive-body case 208 includes, among other components, a photosensitive drum 211 to be rotated and a charging roller 212 for uniformly applying electrical charge to a round surface of the photosensitive drum 211. The development-body case 209 includes a development-agent container 213 for storing development agent. Here, the development-agent container 213 is integrally formed with the development-body case 209. The development-body case 209 further includes an agitating unit 214 for stirring the development agent inside the development-agent container 213, a development roller 215 urged against the round surface of the photosensitive drum 211, a supply roller 216 for supplying the development agent from the development-agent container 213 to the development roller 215, and a development blade 217 placed in contact with the round surface of the development roller 215.

Around the process cartridge 203 inside the housing case 201 are provided a laser printing unit 218, a transfer roller 219, a paper-supply tray 220, a paper-supply roller 221, a fixation unit 222, and a paper-holding plate 223. The laser printing unit 218 generates a static latency image on the round surface of the photosensitive drum 211. The transfer roller 219 transfers a toner image from the photosensitive drum 211 to a print sheet after the toner image is created by supplying the development agent from the development roller 215 to the photosensitive drum 211. The paper-supply tray 220 is kept in such a position so as to hold a stack of print sheets on a slanted surface. The paper-supply roller 221 supplies the print sheets. The fixation unit 222 fixes the toner image after it is transferred onto a supplied printed sheet. The paper-holding plate 223 keeps the printed sheets in place after they are supplied from the fixation unit 222. The case 210 is provided with an opening 224, through which the photosensitive drum 211 comes in contact with the transfer roller 219.

Each of the side plates of the housing case 201 is provided with two guides 225 and 226 formed thereon. The guides 225 and 226 guide the process cartridge 203 when the process cartridge 203 is removed from or inserted into the housing case 201. Each of the side surfaces of the case 210 has two guide pins 227 and 228 formed thereon, and the guide pins 227 and 228 fit in the guides 225 and 226, respectively. Removal or insertion of the process cartridge 203 is carried out from a side of the housing case 201 where the paper-holding plate 223 is located. When the removal or the insertion is to be attempted, the paper-holding plate 223 is rotated to provide space for the process cartridge 203.

The process cartridge 203 is provided with a shutter member 229, which covers the opening 224 when placed in a closed position.

FIG. 11 through FIG. 16 are illustrative drawings for explaining a mechanism of the shutter member 229.

Each side of the case 210 is provided with an arm member 230. One end of the arm member 230 is attached to a side of the case 210 via a pivot pin 231 so as to be able to move about the pivot pin 231. The other end of the arm member 230 is provided with a connection frame 230*a*, which connects the two arm members 230 between one side of the case 210 and the other side of the case 210. Further, this end of the arm member 230 is connected to the shutter member 229 such that the shutter member 229 can move about the connection point. The connection point between the arm member 230 and the shutter member 229 is provided with a spring 232, which urges the shutter member 229 against an exterior surface of the case 210. A connection point between the arm member 230 and the case 210 is provided with a spring 233. The spring 233 urges the arm member 230 such that the shutter member 229 is pushed toward a position where it closes the opening 224. When the shutter member 229 is placed in a position to close the opening 224, an end edge of the shutter member 229 is situated over a perimeter of the opening 224. Here, the end edge of the shutter member 229 refers to an edge on a front side when the shutter member 229 moves toward a position to cover the opening 224.

The arm member 230 has a protrusion 234 which engages the guide 226 when the process cartridge 203 is installed inside the housing case 201. As the process cartridge 203 is inserted into the housing case 201, the protrusion 234 comes under a force applied by the guide 226, so that the arm member 230 is shifted to open the shutter member 229.

Figure 17:
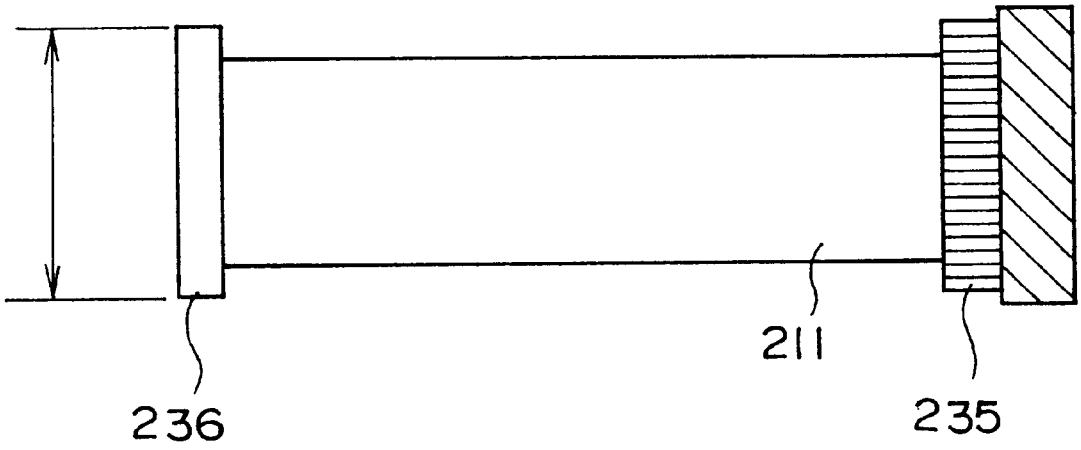
FIG. 17 is an illustrative drawing showing a configuration of a photosensitive drum of FIG. 10.

FIG. 17 is an illustrative drawing showing a configuration of the photosensitive drum 211.

As shown in FIG. 17, one end of the photosensitive drum 211 has a cog 235 fixedly attached thereto, where a rotational drive is conveyed to the photosensitive drum 211 via the cog 235. The other end of the photosensitive drum 211 has a flange 236 fixedly attached thereto. Diameters of the cog 235 and the flange 236 are larger than the diameter of the photosensitive drum 211.

Figure 18:
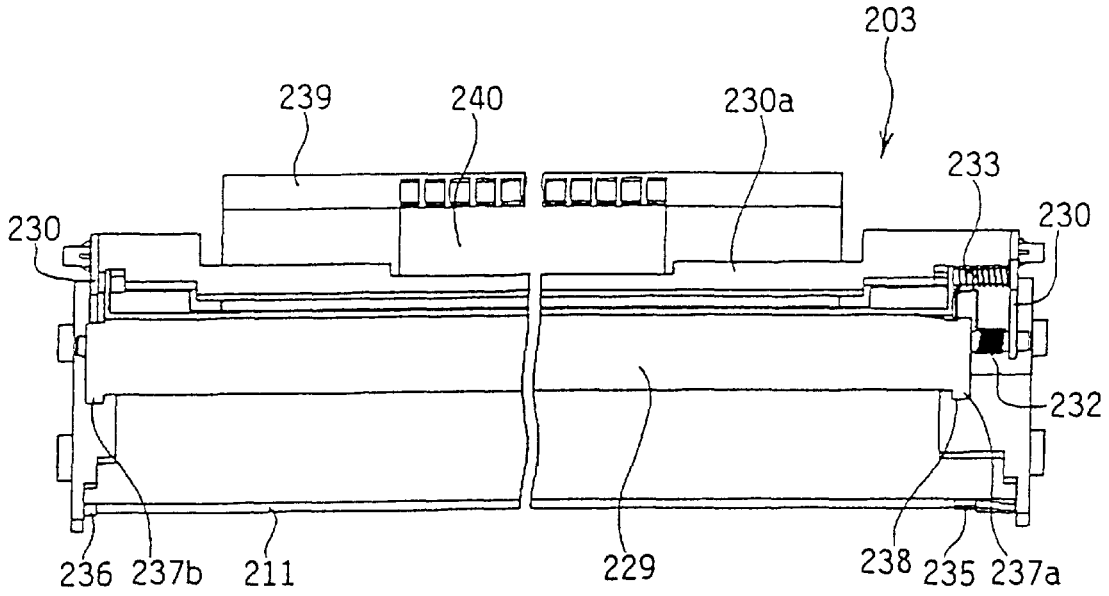
FIG. 18 is an illustrative drawing showing a front view of a process cartridge of FIG. 10.

FIG. 18 is an illustrative drawing showing a front view of the process cartridge 203.

As shown in FIG. 18, either side end of the shutter member 229 is provided with a tip portion 237*a* or a tip portion 237*b*. The tip portion 237*a* comes in contact with and slides over the cog 235, and the tip portion 237*b* comes in contact with and slides over the flange 236. The tip portion 237*a*, which contacts the cog 235, has a curved surface 238 as shown in FIG. 11, such that the tip portion 237*a* is not hooked to the teeth of the cog 235.

The case 210 has a handle 239 on an upper surface thereof, and this handle 239 is grabbed by a hand when the process cartridge 203 is removed from or inserted into the housing case 201. As shown in FIG. 18, the handle 239 has a hole 240 where fingers may be put through when grabbing the handle 239. When the process cartridge 203 is put in place inside the housing case 201, the shutter member 229 is in a position to expose the photosensitive drum 211 as shown in FIG. 18. This is done through the shifting of the arm member 230. In the opened position, the rear end of the shutter member 229 and the connection frame 230*a* do not project toward the hole 240. Here, the rear end of the shutter member 229 refers to an end on a rear side when the shutter member 229 moves toward a position to cover the photosensitive drum 211.

Figure 11:
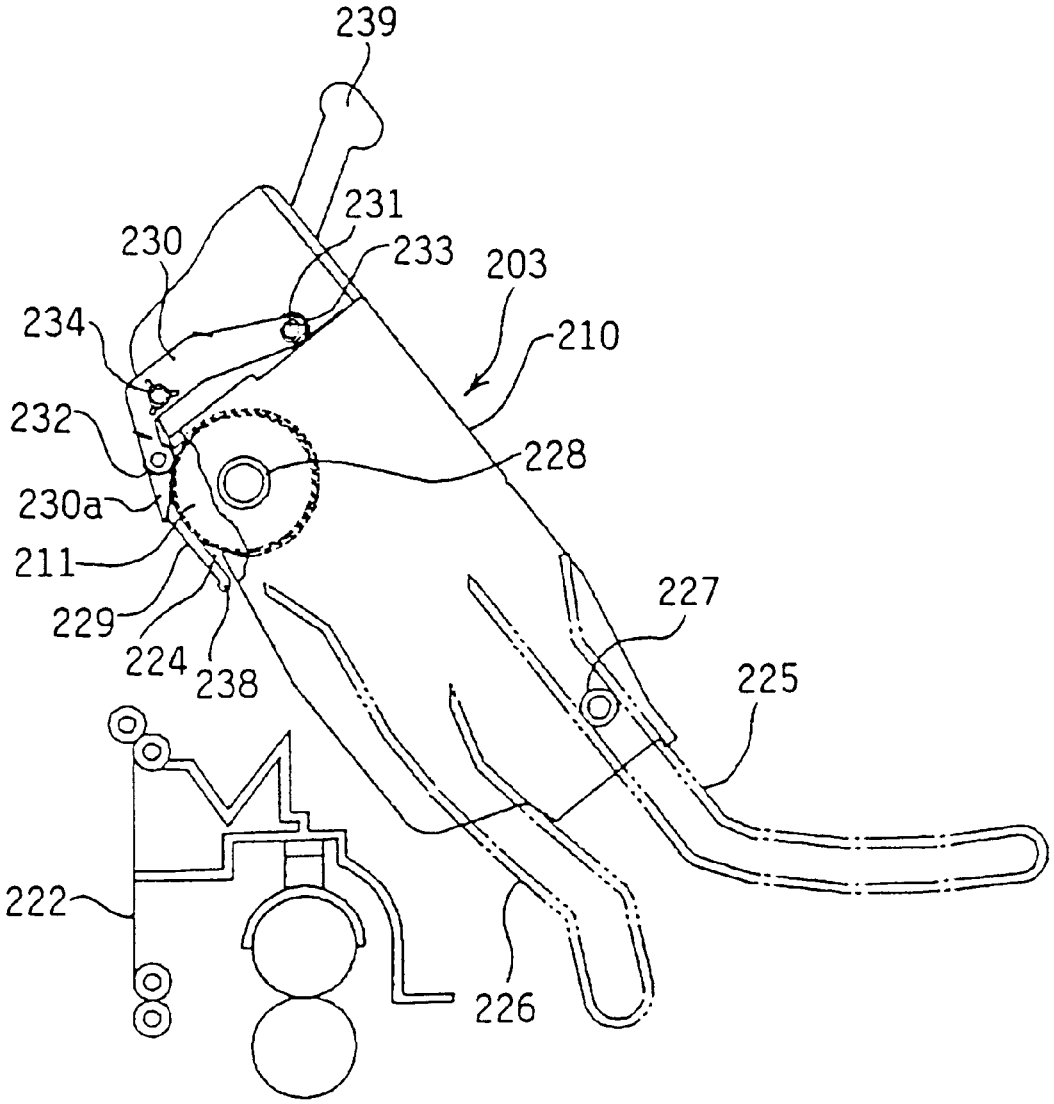
FIG. 11 is an illustrative drawing for explaining a mechanism of a shutter member.
Figure 12:
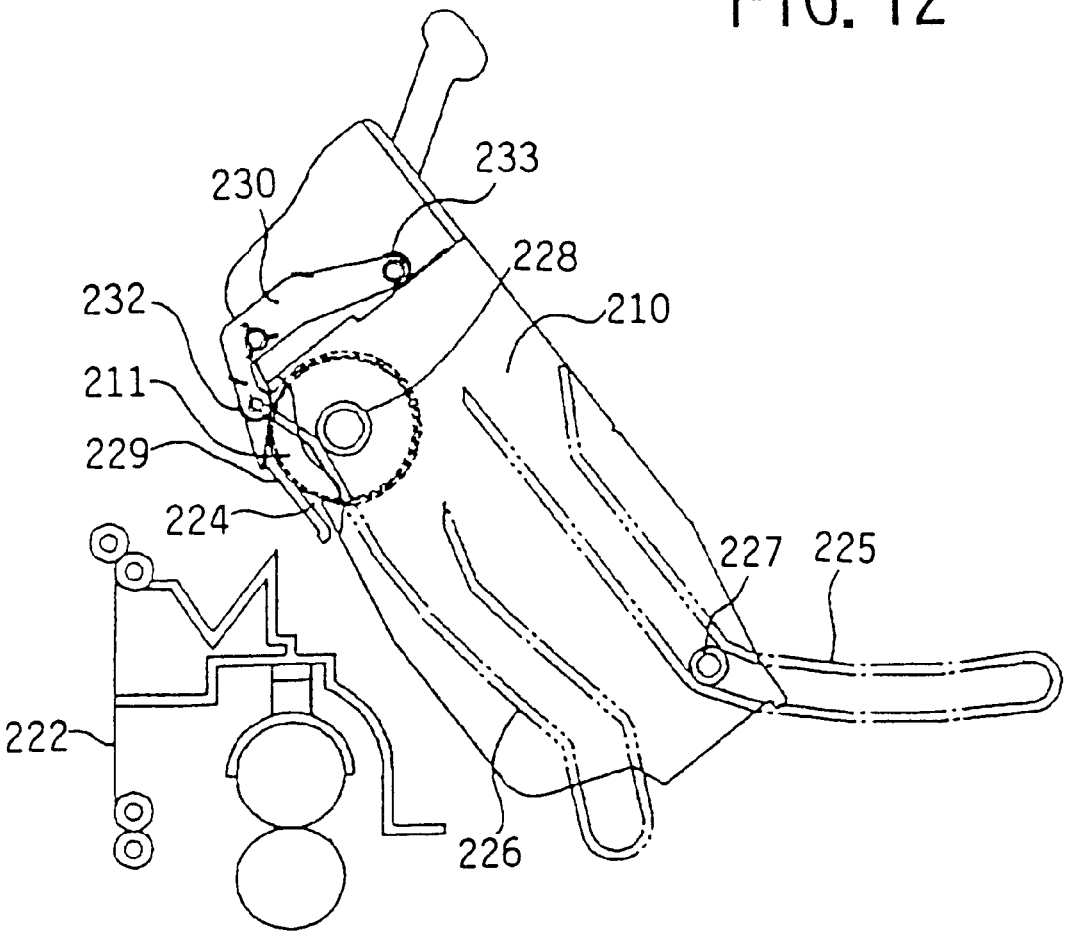
FIG. 12 is an illustrative drawing for explaining a mechanism of the shutter member.

FIG. 11 and FIG. 12 show initial stages in a process of inserting the process cartridge 203 into the housing case 201. In FIG. 11, the guide pin 227 alone is inserted into the guide 225. FIG. 12 shows the process cartridge 203 inserted slightly further into the housing case 201, so that the guide pin 228 is also inserted into the guide 226. In this condition, the arm member 230 is urged by the spring 233 to be in a position such that the shutter member 229 covers the opening 224. The shutter member 229 keeps contact with the exterior surface of the case 210 because of the urging force applied by the spring 232, and the end edge of the shutter member 229 is situated over the perimeter of the opening 224.

In this manner, when the process cartridge 203 is not yet put in place inside the housing case 201, the shutter member 229 covers the opening 224, thereby preventing fingers or other materials from entering through the opening 224 and inflicting damage to the photosensitive drum 211. Since the end edge of the shutter member 229 overlaps the perimeter of the opening 224, the shutter member 229 does not touch the photosensitive drum 211 even if the shutter member 229 is pressed inward and is slightly bent by the pressing.

Figure 13:
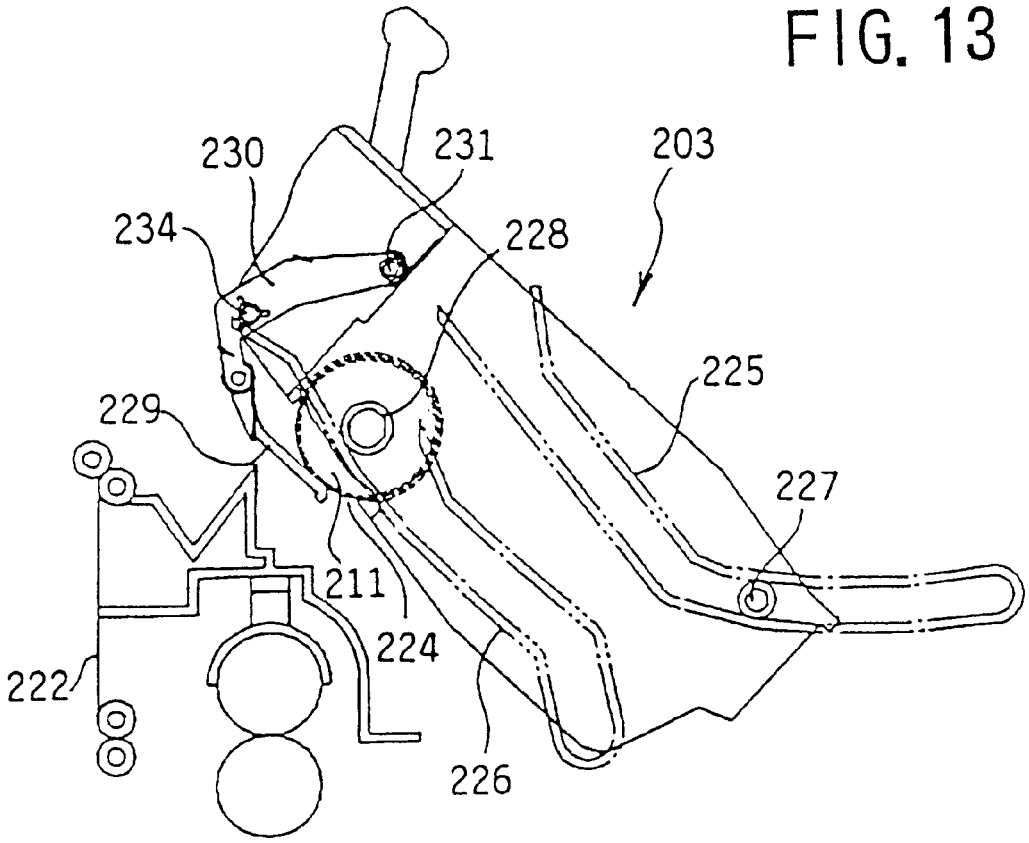
FIG. 13 is an illustrative drawing for explaining a mechanism of the shutter member.
Figure 14:
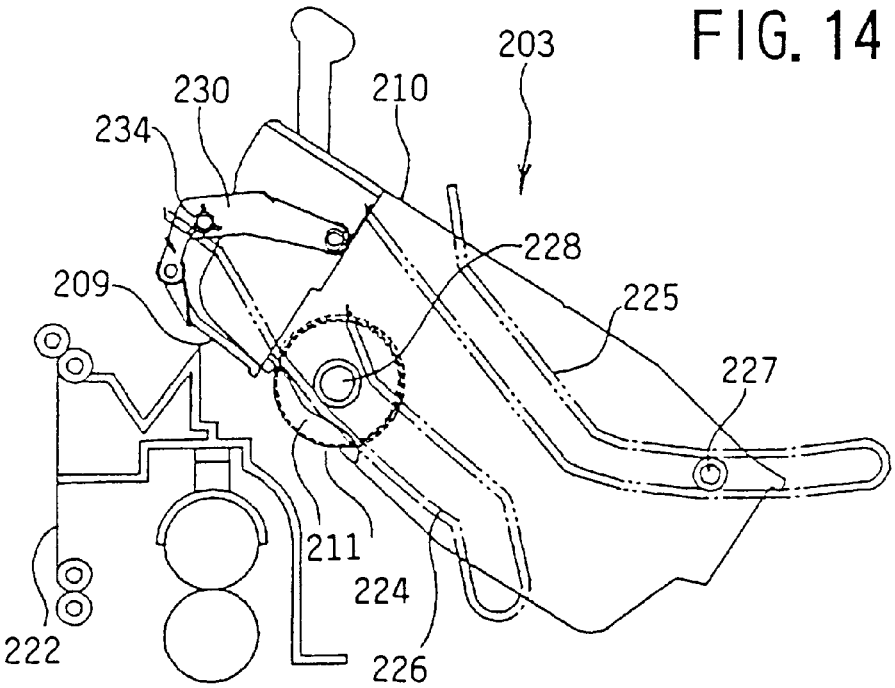
FIG. 14 is an illustrative drawing for explaining a mechanism of the shutter member.
Figure 15:
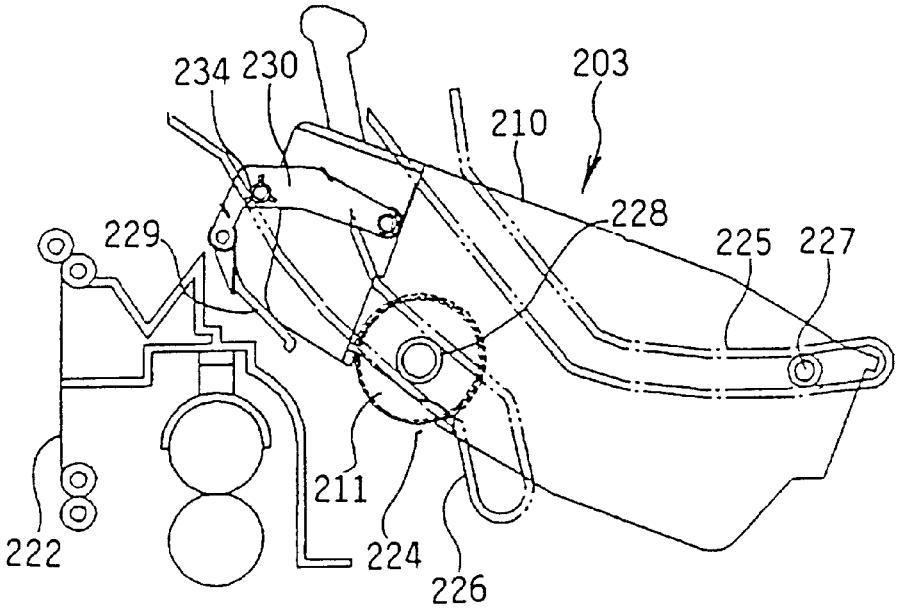
FIG. 15 is an illustrative drawing for explaining a mechanism of the shutter member.

FIG. 13 through FIG. 15 show subsequent stages of the process of inserting the process cartridge 203 into the housing case 201 wherein the protrusion 234 of the arm member 230 is inserted into the guide 226. As the process cartridge 203 is pressed toward inside the housing case 201, the protrusion 234, which is forced to follow a path of the guide 226, receives a force from the guide 226. Because of this force, the arm member 230 is moved upward about the pivot pin 231, so that the shutter member 229 starts shifting from a closed position to an open position. FIG. 13 shows the opening 224 which is half open, and FIG. 14 and FIG. 15 show the opening 224 which is completely open. During a process in which the shutter member 229 shifts toward the open position, the shutter member 229 keeps contact with the exterior surface of the case 210 since an urging force is provided by the spring 232.

Figure 16:
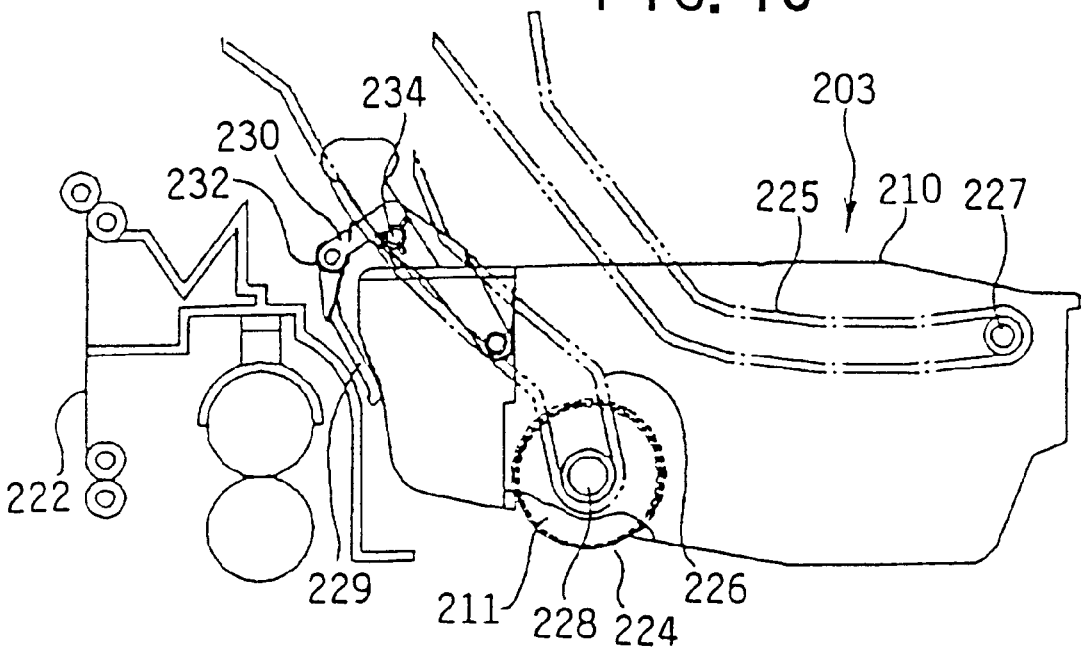
FIG. 16 is an illustrative drawing for explaining a mechanism of the shutter member.

FIG. 16 shows the process cartridge 203 in place inside the housing case 201. The guide pins 227 and 228 are situated at the end of the guides 225 and 226, respectively, so that the process cartridge 203 can be securely held in place. The shutter member 229 is in the open position with the opening 224 being exposed, and is urged against the exterior surface of the case 210 by the spring 232. In this manner, the shutter member 229 moves from the closed position covering the opening 224 to the open position as the process cartridge 203 is inserted into the housing case 201. During this movement, the shutter member 229 slides alongside and keeps contact with the exterior surface of the case 210 because of the spring 232 urging the shutter member 229 against the exterior surface of the case 210. Because of this configuration, the shutter member 229 does not need an extra space around the case 210 when it opens. The shutter member 229 can be easily provided for the process cartridge 203 even when the image-formation device and the process cartridge 203 are subjected to miniaturization.

Further, when the shutter member 229 moves from the closed position to the open position, the tip portions 237*a* and 237*b* formed at side ends of the shutter member 229 slide on the perimeter of the cog 235 and the perimeter of the flange 236, respectively. This configuration provides a space between the end edge of the shutter member 229 and the surface of the photosensitive drum 211 during the process of opening the shutter member 229, thereby preventing the shutter member 229 from touching the photosensitive drum 211. Also, the curved surface 238 is formed at the tip portion 237*a* which slides on the cog 235, so that the tip portion 237*a* does not hook the teeth of the cog 235, avoiding undesirable stoppage of the sliding motion. When the process cartridge 203 is taken out from the process cartridge 203 for maintenance inspection, for example, the photosensitive drum 211 has to be protected since it will be inserted and used again after the inspection. In such a case, preventing the tip portion 237*a* from hooking the cog 235 is necessary in order to ensure that the shutter member 229 moves to the position to close the opening 224.

When the process cartridge 203 is put in place inside the housing case 201, the rear end of shutter member 229 and the connection frame 230*a* do not project toward the hole 240. This configuration helps in putting fingers through the hole 240 without touching the rear end of the shutter member 229 or the connection frame 230*a* when grabbing the handle 239 with an aim of removing the process cartridge 203 from the housing case 201. This assists in smooth and easy removal of the process cartridge 203.

As described above, the present invention provides a shutter mechanism of a process cartridge in which the shutter member is pressed against the exterior surface of the case and kept in this position when the arm member is moved so as to shift the shutter member from the closed position to the open position. Since the shutter member is situated alongside the exterior surface of the case all the time, the shutter member does not need an extra space around the case, thereby facilitating miniaturization of the image-formation device and the process cartridge.

According to another aspect of the present invention, the shutter member is caught by the guide so that the shutter member moves relative to the process cartridge during the process of inserting the process cartridge into the image-formation device. This achieves automatic shift of the process cartridge from the closed position covering the opening to the open position exposing the opening. Further, the process cartridge is pressed against the exterior surface of the case, so that the shutter member is situated alongside the exterior surface of the case all the time. This means that the shutter member does not need an extra space around the case, thereby facilitating miniaturization of the image-formation device and the process cartridge.

According to another aspect of the present invention, the shutter member has a protrusion which fits into the guide when the process cartridge is inserted into the image-formation device, so that the protrusion receives a force from the guide, and this force serves to shift the shutter member from the closed position to the open position. Namely, a mechanism for moving the shutter member from the closed position to the open position during the process of inserting the process cartridge is implemented by simply providing this protrusion. This shutter-shift mechanism thus is based on a simple configuration which is easy to implement.

According to another aspect of the present invention, one end of the photosensitive drum is provided with a cog for conveying a rotational drive, and the other end thereof is provided with a flange, wherein the cog and the flange have a diameter larger than that of the photosensitive drum. Since the side ends of the shutter member slide on the cog and the flange, no physical contact occurs between the shutter member and the photosensitive drum, thereby preventing the photosensitive drum from sustaining damage.

According to another aspect of the present invention, the side ends of the shutter member are provided with a tip portion which slides on the cog and the flange, so that a larger distance is kept between the photosensitive drum and the shutter member when the shutter member moves over the photosensitive drum. This configuration provides further security to prevent physical contact between the photosensitive drum and the shutter member.

According to another aspect of the present invention, the tip portion which slides on the cog has a curved surface. With this curved surface, the tip portion does not hook the teeth of the cog when sliding on the perimeter of the cog during the shift of the shutter member. The shift of the shutter member, therefore, is not hindered, and a smooth shift is guaranteed.

According to another aspect of the present invention, the end edge of the shutter member in the closed position overlaps the perimeter of the opening. Even if a force is applied to the shutter member of this configuration in the closed position, the shutter member is free from yielding and touching the photosensitive drum, thereby preventing the photosensitive drum from sustaining damage.

According to another aspect of the present invention, the handle is formed on the upper surface of the case of the process cartridge, and is provided with a hole to put fingers through. Further, the shutter member is designed such that the rear end thereof does not project toward the hole of the handle when the shutter member is put in the open position. Because of this configuration, the rear end of the shutter member does not stand in the way of the fingers when the process cartridge is removed or inserted by hand, thereby ensuring a smooth removal/attachment of the process cartridge.

Further, the present invention is not limited to these embodiments, but various variations and modifications may be made without departing from the scope of the present invention.

What is claimed is:

1. A method of assembling a process cartridge including a photosensitive-body case having a photosensitive drum stored therein and a development-body case having a development roller stored therein, said method comprising the steps of:

a) positioning a rotation center of said photosensitive drum relative to a rotation center of said development roller by inserting a fixture into two respective recesses provided at the rotation center of said photosensitive drum and the rotation center of said development roller; and b) fixing relative positions of said photosensitive-body case and said development-body case while said fixture is in place.

2. The method as claimed in claim 1, wherein said step b) comprises a step of fixing said relative positions by fastening at least one screw to connect said photosensitive-body case and said development-body case.

3. The method as claimed in claim 1, further comprising, prior to said step a), a step c) of connecting said photosensitive-body case and said development-body case together by a pivot pin such that said photosensitive-body case and said development-body case can move about said pivot pin.

4. The method as claimed in claim 3, wherein said pivot pin extends in parallel to a rotation axis of said photosensitive drum and to a rotation axis of said development roller.

5. A method of assembling a process cartridge including a photosensitive-body case having a photosensitive drum stored therein and a development-body case having a development roller stored therein, said method comprising the steps of:

a) positioning a rotation center of said photosensitive drum relative to a rotation center of said development roller by use of a fixture; and b) fixing relative positions of said photosensitive-body case and said development-body case while said fixture is in place, wherein said step a) comprises a step of inserting two pins of said fixture into two respective recesses provided at said rotation center of said photosensitive drum and said rotation center of said development roller.

6. A process cartridge comprising;

a photosensitive drum;

a photosensitive-body case having said photosensitive drum stored therein;

a development roller;

a development-body case having said development roller stored therein;

a first rotation-center part having a first recess which is positioned at a rotation center of said photosensitive drum;

a second rotation-center part having a second recess which is positioned at a rotation center of said development roller; and a plurality of pins fixedly connecting said photosensitive-body case with said development-body case.

7. The process cartridge as claimed in claim 6, wherein at least one of said plurality of pins comprises a screw.

8. The process cartridge as claimed in claim 6, wherein said photosensitive-body case and said development-body case can move about one of said plurality of pins when others of said plurality of pins are absent, said one of said plurality of pins extending in a direction parallel to a rotation axis of said photosensitive drum and to a rotation axis of said development roller.

9. The process cartridge as claimed in claim 8, further comprising:

a first cog attached to and rotating with said photosensitive drum; and a second cog attached to and rotating with said development roller, said second cog engaging said first cog;

wherein said one of said plurality of pins is positioned such that said photosensitive drum and said development roller are subjected to a force pulling said photosensitive drum and development roller closer to each other when said first cog and said second cog rotate.

10. A process cartridge comprising;

a photosensitive drum;

a photosensitive-body case having said photosensitive drum stored therein;

a development roller;

a development-body case having said development roller stored therein;

a plurality of pins fixedly connecting said photosensitive-body case with said development-body case, wherein said photosensitive-body case and said development-body case can move about one of said plurality of pins when others of said plurality of pins are absent, said one of said plurality of pins extending in a direction parallel to a rotation axis of said photosensitive drum and to a rotation axis of said development roller;

a first cog attached to and rotating with said photosensitive drum; and a second cog attached to and rotating with said development roller, said second cog engaging said first cog;

wherein said one of said plurality of pins is positioned such that said photosensitive drum and said development roller are subjected to a force pulling said photosensitive drum and development roller closer to each other when said first cog and said second cog rotate said force being generated by rotation of the engaged first and second cogs.

11. An image-formation device for printing an image on a sheet; said image-formation device comprising:

a case body; and a process cartridge which is stored in and removable from said case body, wherein said process cartridge comprises:

a photosensitive drum;

a photosensitive-body case having said photosensitive drum stored therein;

a development roller;

a development-body case having said development roller stored therein;

a first rotation-center part having a first recess which is positioned at a rotation center of said photosensitive drum;

a second rotation-center part having a second recess which is positioned at a rotation center of said development roller; and a plurality of pins fixedly connecting said photosensitive-body case with said development-body case.

12. An image-formation device for printing an image on a sheet; said image-formation device comprising:

a case body, and a process cartridge which is stored in and removable from said case body, wherein said process cartridge comprises;

a photosensitive drum;

a photosensitive-body case having said photosensitive drum stored therein;

a development roller;

a development-body case having said development roller stored therein;

a plurality of pins fixedly connecting said photosensitive-body case with said development-body case, wherein said photosensitive-body case and said development-body case can move about one of said plurality of pins when others of said plurality of pins are absent, said one of said plurality of pins extending in a direction parallel to a rotation axis of said photosensitive drum and to a rotation axis of said development roller;

a first cog attached to and rotating with said photosensitive drum; and a second cog attached to and rotating with said development roller, said second cog engaging said first cog;

wherein said one of said plurality of pins is positioned such that said photosensitive drum and said development roller are subjected to a force pulling said photosensitive drum and development roller closer to each other when said first cog and said second cog rotate said force being generated by rotation of the engaged first and second cogs.

13. A process cartridge comprising:

a photosensitive drum;

an image-formation unit forming an image on said photosensitive drum;

a case containing said photosensitive drum and said image-formation unit and having an upper surface; and a handle protruding from said upper surface of said case and having a tip thereof barely touching an interior of a cover when said process cartridge is inserted into a housing case having said cover and when said cover is shut.

14. An image-formation device comprising:

a housing case having a cover; and a process cartridge which is stored in and removable from said housing case, wherein said process cartridge comprises:

a photosensitive drum;

an image-formation unit forming an image on said photosensitive drum;

a case containing said photosensitive drum and said image-formation unit and having an upper surface; and a handle protruding from said upper surface of said case and having a tip thereof barely touching an interior of said cover when said process cartridge is inserted into said housing case and when said cover is shut.

15. The image-formation device as claimed in claim 14, wherein said handle is positioned such that said cover pushes said handle when said cover is shut so as to place said process cartridge in an appropriate position inside said housing case.

16. A process cartridge having a case which contains a photosensitive drum and a development roller, and has an opening to expose said photosensitive drum when put in place inside an image-formation device, said process cartridge comprising:

a shutter member which covers said opening in a first position and exposes said opening in a second position; and at least one arm member connecting said shutter member to said case, wherein said shutter member slides along an exterior surface of said case when moving between said first position and said second position.

17. The process cartridge as claimed in claim 16, further comprising an urging member which urges said shutter member against said exterior surface of said case when said shutter member is in said first position, in said second position, and in any position between said first position and said second position.

18. The process cartridge as claimed in claim 16, wherein said shutter member has an end edge thereof situated over a perimeter of said opening when said shutter member is put in said first position.

19. The process cartridge as claimed in claim 16, further comprising a handle provided on an upper surface of said process cartridge, said handle having a hole to put fingers through, wherein said shutter member stops short of projecting towards said hole when said shutter member is placed in said second position.

20. An image-formation device comprising:

a housing case having a cover; and a process cartridge which is stored in and removable from said housing case, wherein said process cartridge comprises:

a photosensitive drum;

a development roller;

a cartridge case containing said photosensitive drum and said development roller and having an opening to expose said photosensitive drum when put in place inside said image-formation device;

a shutter member which covers said opening in a first position and exposes said opening in a second position; and at least one arm member connecting said shutter member to said cartridge case, wherein said shutter member slides along an exterior surface of said cartridge case when moving between said first position and said second position.

21. The image-formation device as claimed in claim 20, further comprising an urging member which urges said shutter member against said exterior surface of said cartridge case when said shutter member is in said first position, in said second position, and in any position between said first position and said second position.

22. An image-formation device comprising:

a housing case having a cover; and a process cartridge which is stored in and removable from said housing case, wherein said process cartridge comprises:

a photosensitive drum;

an image-formation unit forming an image on said photosensitive drum;

a case containing said photosensitive drum and aid image-formation unit and having an upper surface; and a handle protruding from said upper surface of said case and having a tip thereof barely touching an interior of said cover when said process cartridge is inserted into said housing case and when said cover is shut, wherein said handle extends in a longitudinal direction of said process cartridge.

23. An image-formation device comprising:

a housing case having a cover; and a process cartridge which is stored in and removable from said housing case, wherein said process cartridge comprises:

a photosensitive drum;

an image-formation unit forming an image on said photosensitive drum;

a case containing said photosensitive drum and aid image-formation unit and having an upper surface; and a handle protruding from said upper surface of said case and having a tip thereof barely touching an interior of said cover when said process cartridge is inserted into said housing case and when said cover is shut, wherein said handle protrudes from said upper surface in a direction along which said process cartridge is removed or inserted.

24. An image-formation device comprising:

a housing case having a cover; and a process cartridge which is stored in and removable from said housing case, wherein said process cartridge comprises:

a photosensitive drum;

an image-formation unit forming an image on said photosensitive drum;

a case containing said photosensitive drum and aid image-formation unit and having an upper surface;

a handle protruding from said upper surface of said case and having a tip thereof barely touching an interior of said cover when said process cartridge is inserted into said housing case and when said cover is shut; and a fixation unit provided generally under said handle, wherein said handle has holes formed therethrough.

25. A process cartridge having a case which contains a photosensitive drum and a development roller, and has an opening to expose said photosensitive drum when put in place inside an image-formation device, said process cartridge comprising:

a shutter member which covers said opening in a first position and exposes said opening in a second position;

at least one arm member connecting said shutter member to said case, wherein said shutter member slides along an exterior surface of said case when moving between said first position and said second position; and an urging member which urges said shutter member against said exterior surface of said case when said shutter member is in said first position, in said second position, and in any position between said first position and said second position, wherein said at least one arm member has one end thereof attached to said case via a first pivot point so as to move about said first pivot point, and has another end thereof attached to said shutter member via a second pivot point so as to move about said second pivot point.

26. The process cartridge as claimed in claim 25, wherein said at least one arm member has a protrusion formed thereon, said protrusion fitting into a guide provided inside an image-processing device and receiving a force from said guide when said protrusion is forced to follow a path of said guide as said process cartridge is inserted into said image-processing device.

27. A process cartridge having a case which contains a photosensitive drum and a development roller, and has an opening to expose said photosensitive drum when put in place inside an image-formation device, said process cartridge comprising:

a shutter member which covers said opening in a first position and exposes said opening in a second position;

at least one arm member connecting said shutter member to said case, wherein said shutter member slides along an exterior surface of said case when moving between said first position and said second position;

a cog attached to one end of said photosensitive drum to receive a rotational drive; and a flange attached to another end of said photosensitive drum, wherein a diameter of said cog and a diameter of said flange are larger than a diameter of said photosensitive drum, so that said shutter member slides on said cog and said flange without touching said photosensitive drum.

28. The process cartridge as claimed in claim 27, wherein said shutter member has tip portions formed on side ends thereof, said tip portions sliding on said cog and said flange.

29. The process cartridge as claimed in claim 28, wherein one of said tip portions which slides on said cog has a curved surface so as not to hook teeth of said cog.

30. An image-formation device comprising:

a housing case having a cover; and a process cartridge which is stored in and removable from said housing case, wherein said process cartridge comprises:

a photosensitive drum;

a development roller;

a cartridge case containing said photosensitive drum and said development roller and having an opening to expose said photosensitive drum when put in place inside said image-formation device;

a shutter member which covers said opening in a first position and exposes said opening in a second position;

at least one arm member connecting said shutter member to said cartridge case, wherein said shutter member slides along an exterior surface of said cartridge case when moving between said first position and said second position; and an urging member which urges said shutter member against said exterior surface of said cartridge case when said shutter member is in said first position, in said second position, and in any position between said first position and said second positions, wherein said at least one arm member has one end thereof attached to said cartridge case via a first pivot point so as to move about said first pivot point, and has another end thereof attached to said shutter member via a second pivot point so as to move about said second pivot point.

31. The image-formation device as claimed in claim 30, further comprising a guide provided inside said housing case, wherein said at least one arm member has a protrusion formed thereon, said protrusion fitting into said guide and receiving a force from said guide when said protrusion is forced to follow a path of said guide as said process cartridge is inserted into said housing case.

* * * * *